US012161150B2

(12) United States Patent
Archambault et al.

(10) Patent No.: US 12,161,150 B2
(45) Date of Patent: Dec. 10, 2024

(54) CANNABIS JOINTS FILLING SYSTEM

(71) Applicant: Le Groupe Solid Packaging Robotik Inc., Terrebonne (CA)

(72) Inventors: Robert Archambault, Boisbriand (CA); Daniel Martel, Terrebonne (CA); Harold Bouchard, Bois-des-Filion (CA)

(73) Assignee: Le Groupe Solid Packaging Robotik Inc., Terrebonne (CA)

( * ) Notice: Subject to any disclaimer, the term of this patent is extended or adjusted under 35 U.S.C. 154(b) by 534 days.

(21) Appl. No.: 17/496,435

(22) Filed: Oct. 7, 2021

(65) Prior Publication Data

US 2023/0115581 A1 Apr. 13, 2023

(51) Int. Cl.

| | |
|---|---|
| ***A24C 1/02*** | (2006.01) |
| ***A24C 5/00*** | (2020.01) |
| ***A24C 5/02*** | (2006.01) |

(52) U.S. Cl.

CPC ..... *A24C 1/02* (2013.01); *A24C 5/002* (2013.01); *A24C 5/02* (2013.01)

(58) Field of Classification Search

CPC .. B65B 1/32; B65B 39/12; A24C 1/02; A24C 5/002; A24C 5/02

See application file for complete search history.

(56) References Cited

U.S. PATENT DOCUMENTS

| | | | | |
|---|---|---|---|---|
| 2017/0119043 | A1* | 5/2017 | Swanson et al. | A24C 5/42 |
| 2021/0022388 | A1 | 1/2021 | Sullivan et al. | |
| 2021/0030054 | A1* | 2/2021 | Gowdin et al. | A24C 5/02 |
| 2021/0392944 | A1* | 12/2021 | Kustal et al. | A24C 5/02 |

FOREIGN PATENT DOCUMENTS

| | | | | |
|---|---|---|---|---|
| CA | 3079937 A1 | 5/2019 | | |
| WO | WO 2021/081621 A1 * | 5/2021 | | A24F 47/00 |

OTHER PUBLICATIONS

Merriam-Webster_Definition of Registered https://web.archive.org/web/20200930073256/https://www.merriam-webster.com/dictionary/registered, Retrieved May 20, 2024 (Year: 2020).*

CA 3133600—Office Action, Jun. 3, 2024.

* cited by examiner

*Primary Examiner* — Christopher M Rodd
*Assistant Examiner* — Ronnie Kirby Jordan
(74) *Attorney, Agent, or Firm* — Agence de Brevets Fournier

(57) ABSTRACT

A cannabis joints filling system includes a cannabis joint filling apparatus for receiving and holding a paper cone along a longitudinal axis and for receiving and pre-compacting a predetermined quantity of cannabis into the paper cone; and a cannabis feeding system including i) a weighing scale, ii) a cannabis feeding apparatus adjacent the weighing scale for receiving cannabis in bulk and for controllably outputting a predetermined portion of the cannabis in bulk onto the weighing scale, and iii) a single portion cannabis distributing device, including two cups that are sequentially movable between a) a cannabis weighing position, wherein one of the two cups cooperates with the weighing scale to measure the predetermined portion of the cannabis, and b) a cannabis distributing position, where the predetermined portion of the cannabis is fed to the cannabis joint filling apparatus.

26 Claims, 17 Drawing Sheets

CANNABIS JOINTS FILLING SYSTEM

FIELD

The present disclosure generally relates to cannabis joints and more specifically to a cannabis joints filling system.

BACKGROUND

Cannabis joints have long been and are still very often prepared by hands.

However, the legalization of cannabis in many territories have seen the coming of the automatization in the manufacturing of cannabis joint.

Some of the automated processes in the manufacturing of cannabis involve inserting paper cones in a cone holding tray and then vibrating the whole tray while it receives cannabis in bulk, the vibrations aiming at evening out the filling of the cones.

A drawback of such vibrating tray is that strong and moderate vibrations have been found to separate the delta-9-tétrahydrocannabinol (THC) from cannabis, thereby decreasing the quality of the product.

Another known automated process for the filling of cannabis includes literally injecting cannabis in each cone and then compacting the cannabis.

Drawbacks of such cannabis injection include separation of THC as described hereinabove and the lack of uniformity along the length of the cone considering its shape.

Also, known automated processes of filling cannabis in a paper cone are often imprecise in the quantity inserted in each cone.

SUMMARY

Figure 1:
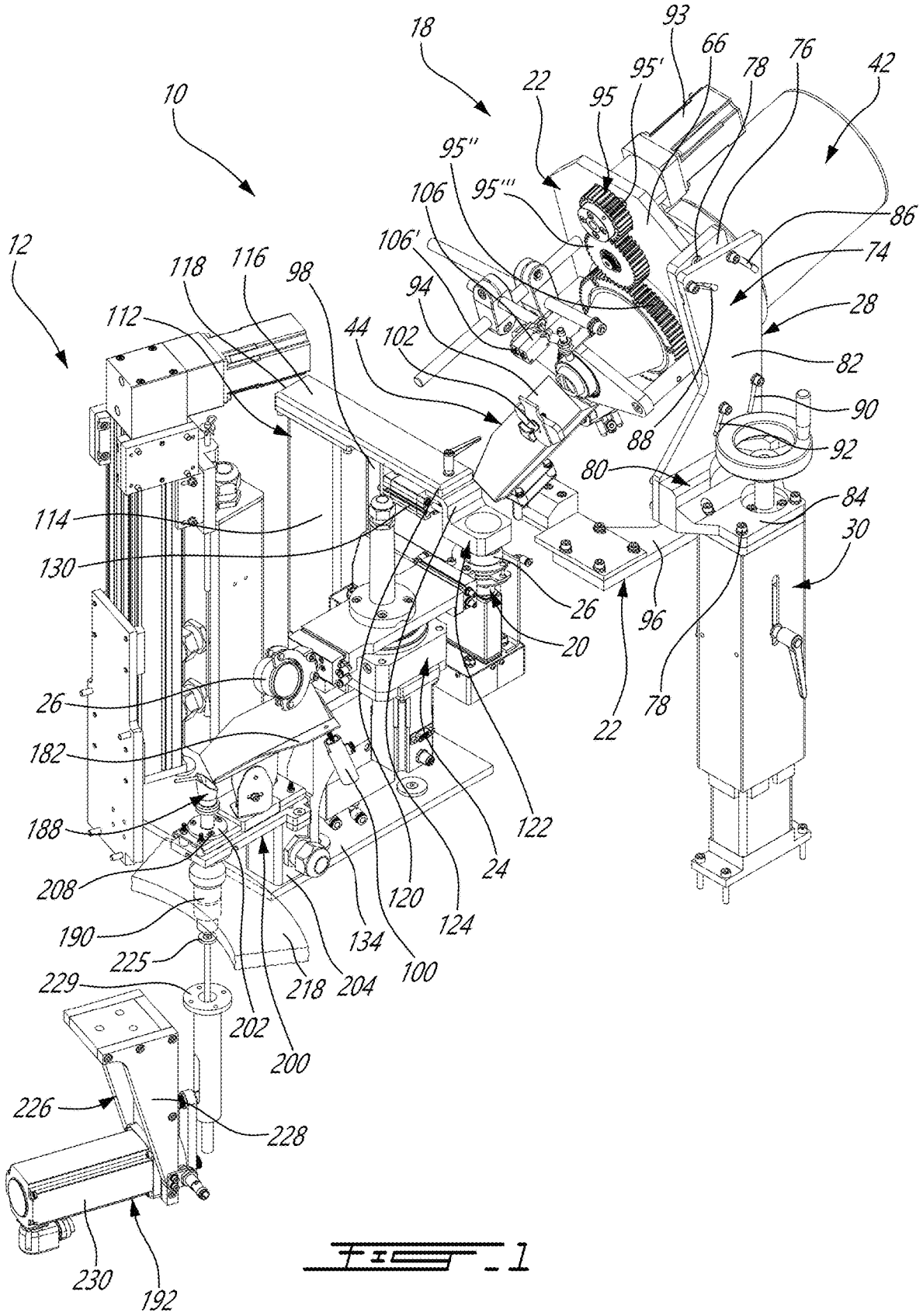
FIG. 1 is a perspective view of a cannabis joints filling system according to a first illustrative embodiment.

According to illustrative embodiments, there is provided a cannabis joints filling system comprising:

a cannabis joint filling apparatus for receiving and holding a paper cone along a longitudinal axis and for receiving and pre-compacting a predetermined quantity of cannabis into the paper cone; and a cannabis feeding system including i) a weighing scale, ii) a cannabis feeding apparatus adjacent the weighing scale for receiving cannabis in bulk and for controllably outputting a predetermined portion of the cannabis in bulk onto the weighing scale, and iii) a device for distributing a single portion of cannabis, including two cups that are sequentially movable between a) a cannabis weighing position, wherein one of the two cups cooperates with the weighing scale to measure the predetermined portion of the cannabis, and b) a cannabis distributing position, where the predetermined portion of the cannabis is fed to the cannabis joint filling apparatus.

According to more specific illustrative embodiments, there is provided:

cannabis joints filling system comprising:

a cannabis joint filling apparatus for receiving and holding a paper cone along a longitudinal axis and for receiving and pre-compacting a predetermined quantity of cannabis into the paper cone; the cannabis joint filling apparatus including i) a reciprocating needle mechanism including a needle, having a conical tip, and ii) an actuating mechanism to controllably cause the needle to reciprocate in the paper cone along the longitudinal axis while moving from a first position, wherein the conical tip is at a bottom of the paper cone, and a second position, wherein the conical tip is out of the paper cone; and a cannabis feeding system including i) a weighing scale, ii) a cannabis feeding apparatus adjacent the weighing scale for receiving cannabis in bulk and for controllably outputting a predetermined portion of the cannabis in bulk onto the weighing scale, and iii) a device for distributing a single portion of cannabis, including two cups that are sequentially movable between a) a cannabis weighing position, wherein one of the two cups cooperates with the weighing scale to measure the predetermined portion of the cannabis, and b) a cannabis distributing position, where the predetermined portion of the cannabis is fed to the cannabis joint filling apparatus;

wherein the cannabis feeding system includes:

a support frame;

a feeding rotary tumbler defining a large inlet and a narrow outlet and that is mounted to the support frame for rotation about a rotational axis that is so angled relative to a horizontal axis that the inlet is higher than the outlet; the feeding cone having an inner surface and including a spiral shaped protrusion on the inner surface;

an actuating mechanism secured to the frame and operatively coupled to the feeding rotary tumbler for selectively causing the rotation of the feeding cone; and a cone extension secured to the feeding cone at the inlet thereof so as to be in fluid communication therewith and defining a recipient to receive the cannabis in bulk;

whereby, in operation, cannabis fed in bulk into the cone extension is brought by gravity and rotation to the inlet of the feeding rotary tumbler and then gradually moved from the inlet of the feeding cone to the outlet thereof by the spiral shaped protrusion when the feeding cone is caused to rotate by the actuating mechanism;

wherein the device for distributing single portions of cannabis includes:

a revolving support that is movable about a first axis; the revolving support being further movable between first and second position along the first axis;

first and second cup holders, each mounted to the revolving support for pivotal movement between a weighing position and a content-emptying position about a second axis that is perpendicular to the first axis, and first and second cups, each mounted to a respective one of the first and second cup holders so as to be free to translate in and out of a position wherein the cup is supported by the cup holder According to other illustrative embodiments, there is provided a cannabis feeding apparatus comprising:

a support frame;

a feeding rotary tumbler defining a large inlet and a narrow outlet and that is mounted to the support frame for rotation about a rotational axis that is so angled relative to a horizontal axis that the inlet is higher than the outlet; the feeding cone having an inner surface and including a spiral shaped protrusion on the inner surface;

an actuating mechanism secured to the frame and operatively coupled to the feeding cone for selectively causing the rotation of the feeding cone; and a cone extension extending from the feeding cone at the inlet thereof so as to be in fluid communication therewith and defining a recipient to receive cannabis in bulk;

whereby, in operation, cannabis fed in bulk into the cone extension is brought by gravity and rotation to the inlet of the feeding cone, and then gradually moved from the inlet of the feeding cone to the outlet thereof by the spiral shaped protrusion when the feeding cone is caused to rotate by the actuating mechanism.

According to still another illustrative embodiment, there is provided a device for distributing single portions of cannabis, the device comprising:

a revolving support that is movable about a first axis; the revolving support being further movable between first and second position along the first axis;

first and second cup holders, each mounted to the revolving support for pivotal movement between a weighing position and a content-emptying position about a second axis that is perpendicular to the first axis, and first and second cups, each mounted to a respective one of the first and second cup holders for free translation in and out of a position wherein the cup is supported by the cup holder.

According to another illustrative embodiment, there is provided a cannabis joint filling apparatus comprising:

a paper cone holder for receiving and holding a paper cone along a longitudinal axis; and a needle, having a conical tip, that is reciprocatable in the paper cone holder along the longitudinal axis while being gradually movable from a first position, wherein the conical tip is at the bottom of the paper cone holder, and a second position, wherein the conical tip is out of the paper cone holder; the conical tip being widest at a distal end thereof;

whereby, in operation, the needle reciprocating in the paper cone received in the paper cone holder while gradually and simultaneously i) moving from the first to the second positions, and ii) the paper cone receiving a predetermined portion of cannabis.

According to another illustrative embodiment, there is provided a method for pre-compacting cannabis in a paper cone, the method comprising:

holding a paper cone along a longitudinal axis; the paper cone having a bottom and an opening;

providing a needle having a conical tip; the conical tip having a widest portion at a distal end thereof that is dimensioned so as to snugly fit into the paper cone at the bottom thereof when inserted along the longitudinal axis;

moving the needle into the paper cone until the distal end of the needle reaches near the bottom of the paper cone; and then simultaneously:

filling a quantity of cannabis in the paper cone so as to fill the paper cone up to a predetermined distance from the opening; and gradually removing the needle from inside the paper cone; and reciprocating the needle in the paper cone along the longitudinal axis;

whereby i) and ii) are so synchronized as to both end substantially simultaneously.

The expression cannabis should be construed herein

Other objects, advantages and features of the cannabis joints filling system will become more apparent upon reading the following non-restrictive description of illustrated embodiments thereof, given by way of example only with reference to the accompanying drawings.

DETAILED DESCRIPTION

In the following description, similar features in the drawings have been given similar reference numerals, and in order not to weigh down the figures, some elements are not referred to in some figures if they were already identified in a precedent figure. Herein, it shall further be noted that, for avoiding unnecessary details obscuring the invention, only device structures and/or processing steps closely relevant to schemes according to the invention are shown in the accompanying drawings while omitting other details less relevant to the invention.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

A first illustrative embodiment of a cannabis joints filling system 10 will now be described with reference first to FIGS. 1 and 2.

The cannabis joints filling system 10 comprises a cannabis joint filling apparatus 12 for receiving and holding a paper cone 14 along a longitudinal axis 16 and for receiving and pre-compacting a predetermined portion of cannabis therein (not shown), and a cannabis feeding system 18 for feeding the predetermined portion of cannabis to the cannabis joint filling apparatus 12.

The predetermined portion of cannabis will also be referred to as a single dose 15 of cannabis 15 (see FIG. 8P) and is a predetermined quantity of cannabis that is intended to fill a paper cone 14 to form a joint. Of course, such a single dose 15 may vary depending on the size of the paper cone 14 to fill.

The cannabis feeding system 18 comprises i) a weighing scale 20, ii) a cannabis feeding apparatus 22, adjacent the weighing scale 20, for receiving cannabis in bulk (not shown) and for controllably outputting the cannabis onto the weighing scale 20, and iii) a single portion cannabis distributing device 24 including two cups 26 that are sequentially movable between a cannabis weighing position, wherein one of the two cups 26 cooperates with the weighing scale 20 to measure the predetermined portion of the cannabis, and a cannabis distributing position, where the predetermined portion of the cannabis is fed to the cannabis joint filling apparatus 12.

With references to FIGS. 1 and 3-5, the cannabis feeding apparatus 22 will now be described in more detail.

The cannabis feeding apparatus 22 comprises a support frame 28 mounted to a height adjustment mechanism 30, a feeding cone 32 defining a large inlet 34 and a narrow outlet 36 and that is mounted to the support frame 28 for rotation about a rotational axis 38, an actuating mechanism 40 secured to the frame 28 and operatively coupled to the feeding cone 32 for selectively causing the rotation thereof about the axis 38, a cone extension 42 secured to the feeding cone 32 at the inlet thereof 34 so as to be in fluid communication therewith, a chute 44 secured to the frame 28, adjacent the feeding cone outlet 36, so as to receive cannabis therefrom, and a controllable gate 45.

The inner surface of the feeding cone 32 includes a spiral-shaped protrusion 46 thereon, which contributes to move cannabis precisely and gradually from the inlet 34 of the feeding cone 32 to the outlet 36 thereof when the feeding cone 32 is caused to rotate by the actuating mechanism 40.

According to another embodiment, the cannabis feeding apparatus 22 is replaced by another apparatus or system allowing to receiving cannabis in bulk and to output a portion thereof to the weighing scale 20.

As will be described hereinbelow in more detail, the cannabis feeding system 18 is further equipped with low and high-level sensors 106-106' which allows detecting the flow of cannabis that exits the feeding cone 32. This feature, in combination with the configuration of the feeding cone 32, notably the spiral-shaped protrusion 46 therein allows optimizing the rotation of the feeding cone 32 to extract its content, which in turn minimizes both its energy consumption and its wear.

Compared to the use of a vibrating conveyor to bring cannabis into the filling system 12, the use of the feeding cone 32 therefore allows an improved control on the cannabis flow into the system 10 and minimizes the aforementioned separation of the delta-9-tétrahydrocannabinol (THC) from cannabis, thereby improving the quality of the product.

The cone extension 42 has a diameter similar to the diameter of the feeding cone 32 at the inlet 34 thereof. Both the feeding cone 32 and the cone extension 42 include an outer flange 48 and 50 respectively at the inlet 34 and outlet 52 thereof. A cushioning washer ring 54 is provided between the feeding cone 32 and cone extension 42 and a clamp collar 56 is provided to secure the joint therebetween. The clamp collar 56 includes two identical complementary C-shaped parts 58, each including a groove 60 therein to receive both flanges 48 and 50 and ring 54 in an abutting relationship The two parts 58 attach the cone extension 42 to the feeding cone 32 when they are assembled thereon using fasteners 62.

According to another embodiment (not shown), the cone extension is detachably or permanently attached to the feeding cone 32 using another attachment than a clamp collar 56. According to still another embodiment, the cone extension 42 is integral to the feeding cone 32.

The inlet 63 of the cone extension 42 is provided with an inward flange 64 that defines an opening thereof that is narrower than its outer diameter.

The cone extension 42 defines a container to receive cannabis in bulk.

It is to be noted that the sizes and configurations of the feeding cone 32 and cone extension 42 may be different than illustrated so as to be adapted for the grade or quantity of cannabis.

The support frame 28 includes a first plate 66 having a circular opening 68 that receives the feeding cone 32 for free rotation therein. For that purpose, the feeding cone 32 is provided with a collar portion 70 extending outwardly therefrom and which includes an annular section 72 that is shaped to be complementary received within the opening 68.

The support frame 28 further includes a generally L-shaped mounting assembly 74 that mounts the first plate 66 to the height adjustment mechanism 30. More specifically, the mounting assembly 74 includes a second plate 76 that fixedly receives the first plate 66 using fasteners 78, and a generally L-shaped member 80 including a third plate 82 that receives the second plate 76 on a first lateral side thereof, and an anchor portion 84 that extends from the third plate 82, generally perpendicular therefrom on a second lateral side thereof.

The anchor portion 84 is fixedly mounted to the height adjustment mechanism 30 using fasteners 78.

The third plate 82 includes grooves 86-92 that allows mounting the second plate via fasteners 78 in a manner that allows adjusting the angle of the second plate 76 and therefore of the axis 38 relative to the horizontal.

The support frame 28 can have another configuration than illustrated. According to another embodiment (not shown), the height adjustment mechanism 30 is omitted and or the support frame 28 has fixed configuration that yields a fixed angle of the axis 38 relative to the horizontal.

Since the height adjustment mechanism 30 are believed to be well-known in the art, it will not be described herein in more detail for concision purposes.

The actuating mechanism 40 includes a rotary actuator 93 secured to the first plate 66 on a first side face thereof, and a transmission mechanism, in the form of a gear assembly 95, rotatably coupling the feeding cone 32 to the actuator 93. The gear assembly 95 includes a first gear 95' secured to the actuator 93, coaxially to the output thereof, a second gear 95" fixedly mounted to the feeding cone 32 on its outer surface coaxially thereto, and a third gear 95'" rotatably mounted to first plate 66 so as to rotatably couple the first and second gears 95' and 95". The gear assembly 95 is on the second side face of the first plate.

According to another embodiment (not shown), the gear assembly is differently configured to transmit the rotational movement of the actuator 93 to the feeding cone 32. According to still another embodiment (not shown), the transmission mechanism takes another form than a gear assembly 95.

The chute 44 includes a V-shaped channel 94 that is mounted to the support frame 28 so as to be positioned at the outlet 36 of the feeding cone 32, operatively below thereof so as to receive cannabis therefrom. The V-shaped channel 94 is positioned between the feeding cone 32 and the weighing scale 20. The V-shaped channel 94 is further slanted similarly to the feeding cone 32 so as to define a smooth continuity thereof.

The support frame 28 further includes an L-shaped mounting assembly 96 that extends from the anchor portion 84 thereof.

The chute 44 further includes a tilting bracket 97 that is mounted at the distal end 98 of the L-shaped mounting assembly 96 and that allows adjusting the angle of the channel 94, and a pneumatic vibrator 100 that is provided to induce vibration selectively and controllably onto the V-shaped channel 94 to reduce friction of the cannabis thereon and hence promote its flow between the feeding cone 32 and the weighing scale 20.

The chute 44 further includes a flow restrainer 102 that is mounted to the V-shaped channel 94 therein. The flow restrainer 102 is in the form of a plate that is so configured as to define a partial stopper within the channel 94, which defines therewith a small opening 104 that aims at limiting the flow of cannabis on the chute 44.

The vibrator 100 is controlled so as induce onto the channel 94 stronger vibrations at first, and then gradually fainter vibrations. This mode of operation of the vibrator 100 aims at rapidly moving a major portion of the predetermined single dose 15 of cannabis from the feeding cone 32 to the weighing scale 20 and then gradually diminishing the flow of cannabis so as to increase the weighing precision.

The vibrator 100 is not limited to the illustrated embodiment and can also be, for example, of the electric type. Since a vibrator 100 is believed to be well-known in the art, it will not be described herein in more detail.

According to another embodiment (not shown), the vibrator 100 can be operated according to another mode. According to still another embodiment (not shown), the vibrator 100 is omitted or replaced by another mechanism or system allowing to promote the flow of cannabis between the feeding cone 32 and weighing scale 20.

The cannabis feeding system 18 is further equipped with low and high-level sensors 106-106', which are mounted side-by-side to the support frame 28 via an adjustable mounting assembly 108 so as to have a line of sight to the first chute 44. The sensors 106-106' are in the form of two identical laser detectors, the first one configured to detect a predetermined low level of cannabis onto the chute 44 and the other to detect a predetermined high level thereof.

When the sensors 106-106' detect that the flow of cannabis onto the channel 94 is reduced or absent, the actuator 40 is energized to rotate the feeding cone a predetermined amount to allow more cannabis towards the weighing scale 20 via the chute 44 and through the gate 45.

The controllable gate 45 includes a recipient 110 that is positioned above the weighing scale 20 by an L-shaped mounting assembly 112, which includes a post 114 and an arm 116 having first and second longitudinal ends 118-120 and being secured to the post 114 near its first longitudinal end 118 so as to extend generally perpendicularly therefrom towards the weighing scale 20. The recipient 110 includes a container portion 122 and a L-shaped mounting portion 124 that extends from the container portion 122 and that is secured to the arm 116 at the second longitudinal end 120 thereof.

The container portion 122 includes a frusto-conical opening 126 that defines a gradually narrowing passage from the V-shaped channel 94 towards the weighing scale 20.

The container 122 further includes a bottom 128 that is slidable between a first position, which closes the opening 126, and a second position, which completely frees the opening 126. For that purpose, the controllable gate 45 further includes a linear actuator 130 that is mounted to the arm 116 thereunder and that is operatively coupled to the bottom 128.

In operation, the controllable gate 45 is operated to allow passage of cannabis from the feeding cone 32, through the V-shaped channel 94, onto the weighing scale 20 until a predetermined amount of cannabis is weighed thereon. The controllable gate 45 is then closed to stop additional cannabis from reaching the scale 20, until the predetermined amount of cannabis is moved to the cannabis joint feeding apparatus 12 by the single portion cannabis distributing device 24 as will be described hereinbelow in more detail. This predetermined amount of cannabis will also be referred to as a single dose of cannabis 15, which is to be filled into each paper cone 14.

It is to be noted that the controllable gate 45 can have another form than illustrated hereinabove. For example, the configuration and size of the recipient 110, mounting assembly 112 and/or actuator 130 can be different.

The weighing scale 20 is an electronic analytical-type scale that includes a plate 132 that is configured and positioned to operatively receive a cup 26 from the single portion cannabis distributing device 24 as will be described hereinbelow in more detail. The weighing scale 20 allows measuring weight as low as 0.001 g. According to the illustrated embodiment, the weighing scale 20 is configured to measure a single dose of cannabis of 0.25 g with a tolerance of 5 percent but can be configured to measure another quantity of cannabis within a different tolerance.

The weighing scale 20 and controllable gate 45 are both secured to a same base 134.

Since an electronic analytical-type scale is believed to be well-known in the art, it will not be described herein in more detail for concision purposes.

The cannabis feeding system 18 is not limited to include an electronic analytical type weighing scale and can be equipped with another type of weighing scale.

The single portion cannabis distributing device 24 will now be described in more detail with reference first to FIG. 6A.

The single portion cannabis distributing device 24 comprises a turntable 136 that is mounted to a primary support base in the form of a gearbox 138 for rotational movement about a rotational axis 140. The distributing device 24 further comprises a secondary support base 142 that receives the primary support base 138 via a linear actuator 144 for reciprocal movement of the primary support base 138 relative to the secondary support base 142 along the rotational axis 140.

More specifically, the linear actuator 144 includes a guide body 146 that is fixedly sat onto the secondary support base 142, a thrust rod 148 that is slidably mounted in the guide body 146 so as to be movable along an axis 150 that is parallel to the axis 140, a sliding support column 152 that is slidably mounted in the guide body 146 for reciprocal movement along an axis 154 parallel to both axes 140 and 150, and a runner plate 156 secured to both the rod 148 and column 152 for reciprocal movement in unison with both rod 148 and column 152.

The primary support base 138 is fixedly sat onto the plate 156 via a spacer plate 158 for reciprocal movement in unison with the plate 156. It results that from the above-described assembly that the turntable 136 is also mounted to the secondary support base 142 for reciprocal movement along the rotational axis 140 in addition to being rotatable thereabout.

Figure 6A:
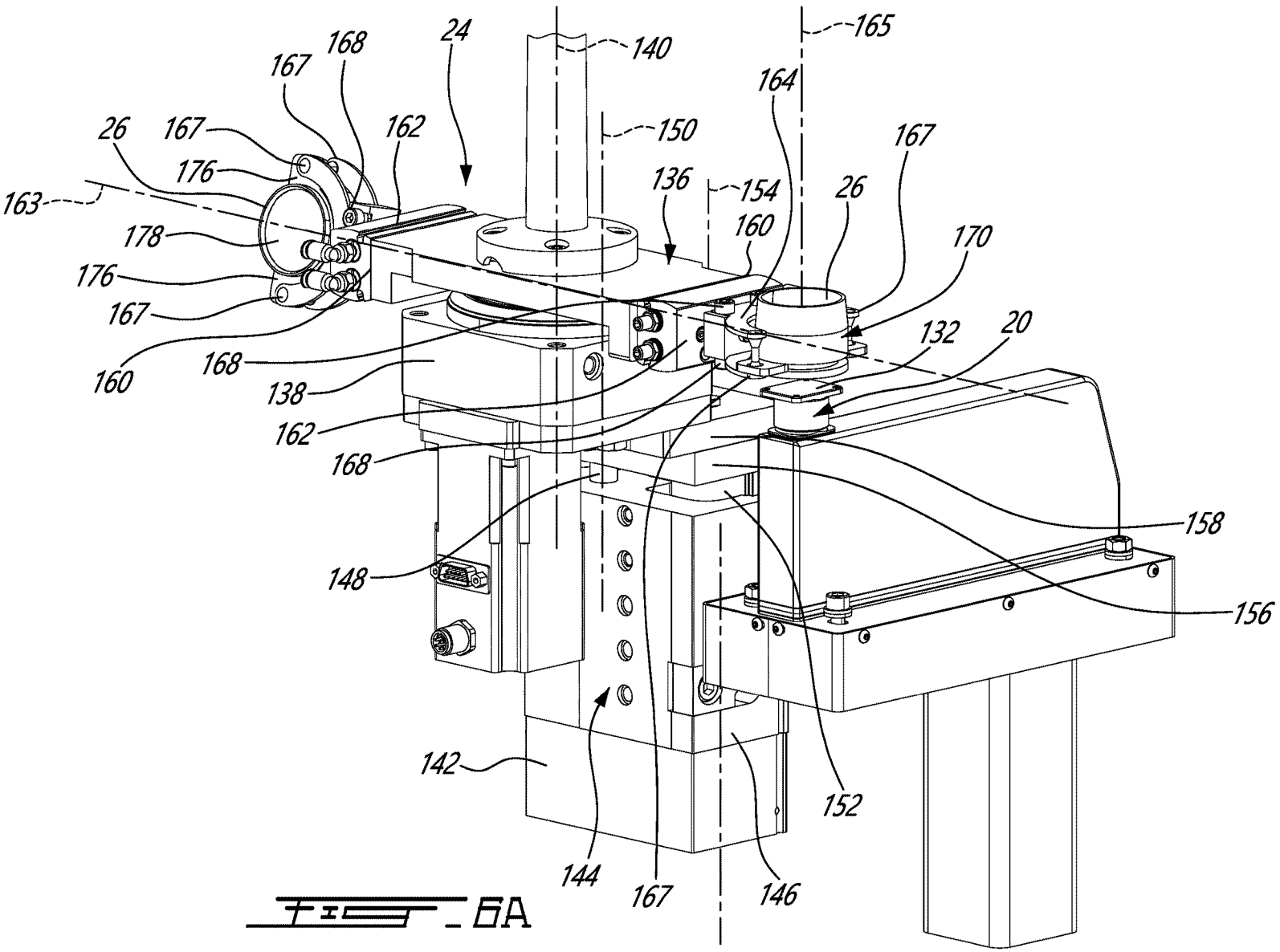
FIGS. 6A and 6B are isolated perspective views of both a weighing scale and a single portion cannabis distributing device that is part of the cannabis joints filling system from FIG. 1, illustrating their operations while weighing a single dose of cannabis.

The two cups 26 are each mounted to a respective lateral side 160 of the turntable 136 via a rotary actuator 162 for pivotal movement about a pivot axis 163 between a first position, wherein the cup 26 is right side up (see the right cup 26 on FIG. 6A), and a second position, wherein the cup 26 is tilted more than ninety (90) degrees, which causes the cup 26 to be emptied of its content (see the left cup 26 on FIG. 6A).

Each cup 26 is mounted to a respective rotary actuator 162 via a mounting bracket 164 for further free sliding movement along an axis 165 that is perpendicular to the pivot axis 163.

Figure 7B:
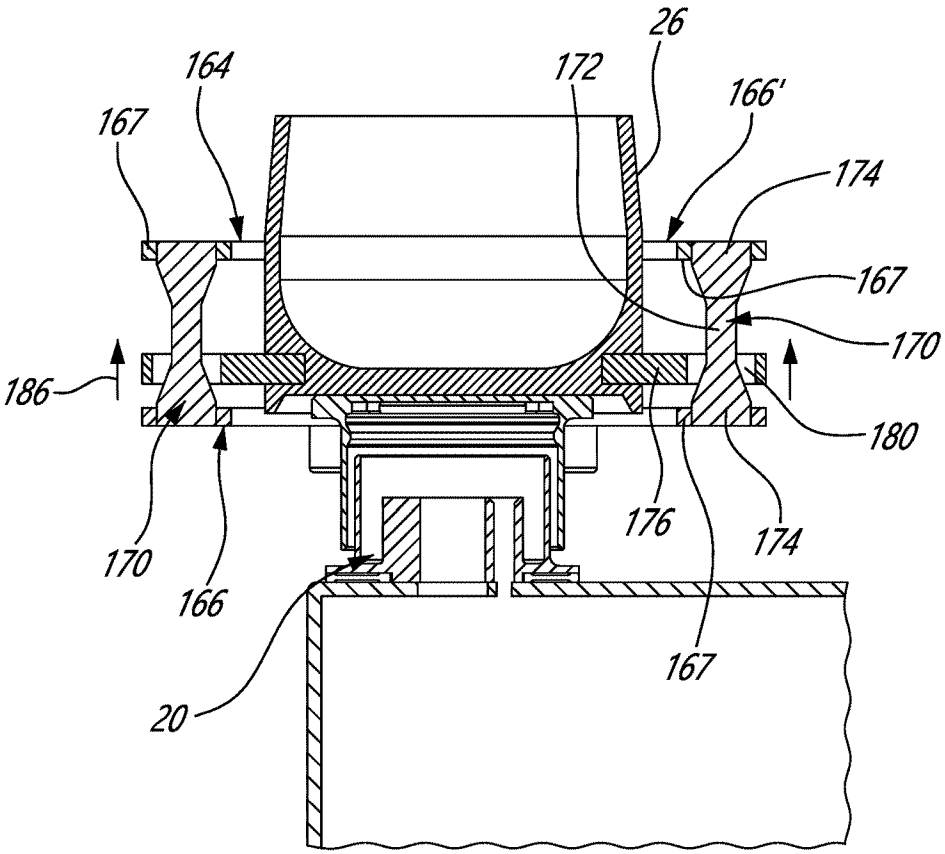
FIGS. 7A and 7B are cross-sections of one of the two cups of the single portion cannabis distributing device, corresponding respectively to FIGS. 6A and 6B.

With references to FIGS. 6A and 7A and 7B, the mounting bracket 164 will now be described in more detail.

Each mounting bracket 164 includes two small C-shaped plates 166-166', each having a middle section and two free ends 167. The C-shaped plates 166-166' are fixedly mounted to the rotary actuator 162 through their middle section using fasteners 168 to be generally parallel one from the other. The pair of C-shaped plates 166-166' are further joined at their facing free ends 167 by spacers 170. The spacers 170 have a narrow middle section 172 and two gradually larger ends 174.

Each of the cups 26 is provided with two fins 176 that extend on diametrically opposite sides thereof, near its bottom 178. Each fin 176 is provided with a hole 180 that receives the spacers 174 therein. The diameter of the hole 180 is dimensioned for receiving the larger ends 174 of the spacers 170 in a snuggly-fit manner.

Figure 7A:
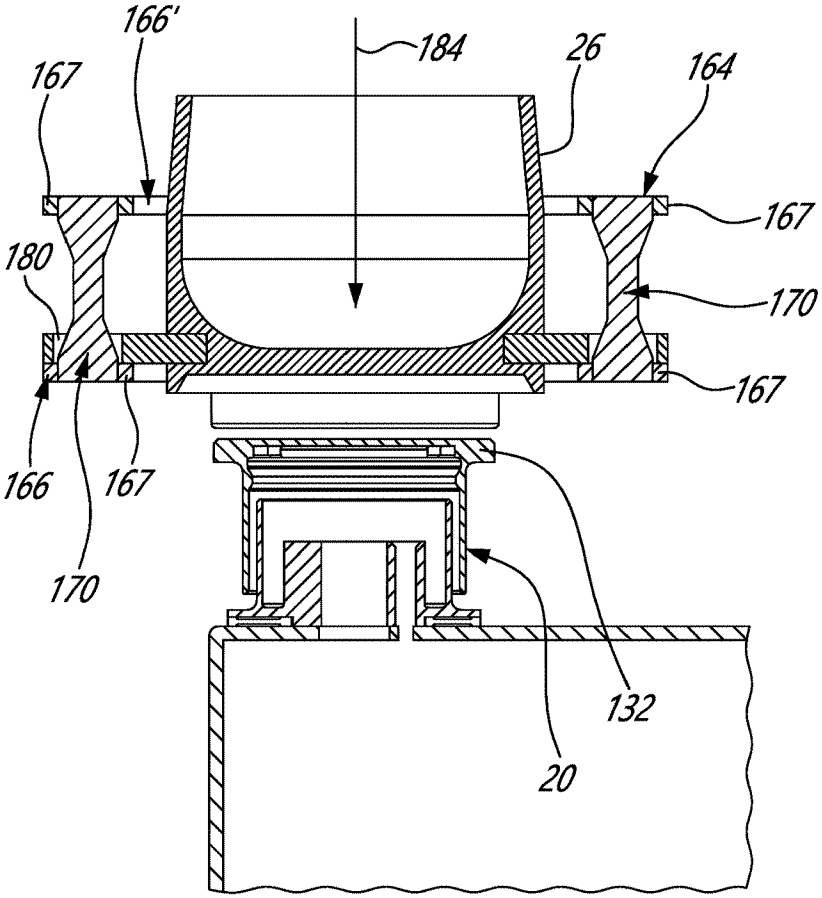

As can be seen in FIG. 7A, each cup 26 is mounted to a respective rotary actuator 162 for free movement between a first rested position, wherein the fins 176 sits on the lower C-shaped plate 166, and a second raised position, wherein the fins 176 abuts the higher C-shaped plate 166' from below. The rested position is naturally reached under the combined force of gravity and rotation when the rotary actuator 162 is in its first position.

The operation of the single portion cannabis distributing device 24 will now be described with references to FIGS. 6B and 7A-7B.

Figure 6B:
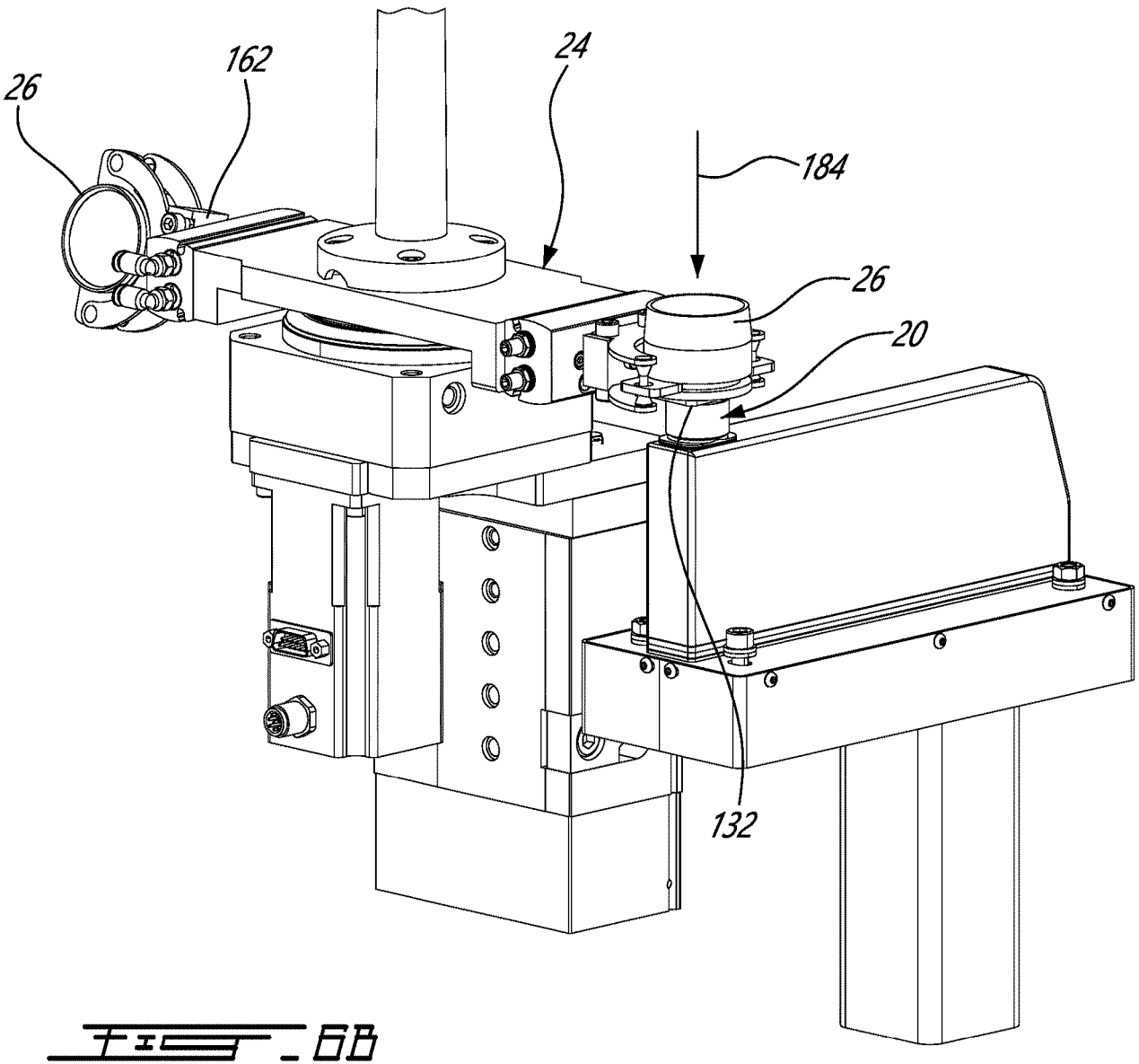

The cup 26 that is on the side of the weighing scale is first moved in its first position, wherein the cup 26 is right side up (see FIGS. 6B and 7A). While in this position, one of its cups 26 is positioned above the weighing scale 20 and coaxially therewith.

Figure 2:
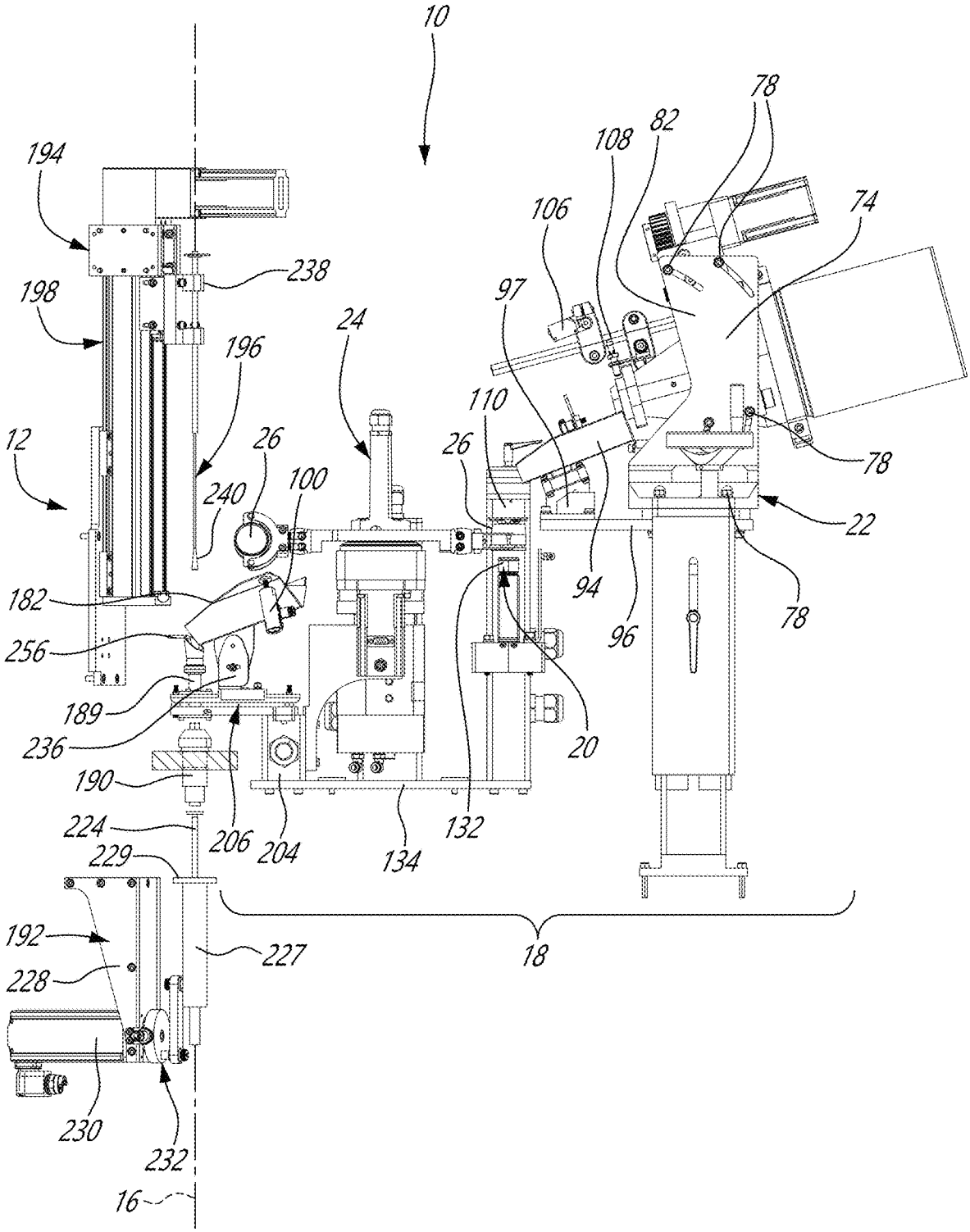
FIG. 2 is a front view of the system from FIG. 1.

As can be seen in FIGS. 1 and 6B, also while in this position of the distributing device 24, the cup 26 that is on the side of the cannabis joint filling apparatus 12 is first positioned above a second chute 182 that is part of the cannabis joint filling system 12, and then tilted by the rotary actuator 162 into its second position so as to drop its content onto the second chute 182. The emptying of the right-side cup 26 into the cannabis joint filling apparatus 12 is therefore performed simultaneously to the weighing of the right-side cup 26 as will now be described in more detail.

The turntable 136 is lowered (see arrow 184 on both FIGS. 6B and 7A) until the right-side cup 26 rests onto the plate 132 of the scale 20. As can be better seen in FIG. 7B, the fins 176 of the cup 26 are then moved from its first rested position towards its second raised position (see arrow 186 on FIG. 7B). It is to be noted that the weighing scale 20 is calibrated to take into account the weight of the empty cup 26 when measuring a predetermined single portion of cannabis.

Figure 3:
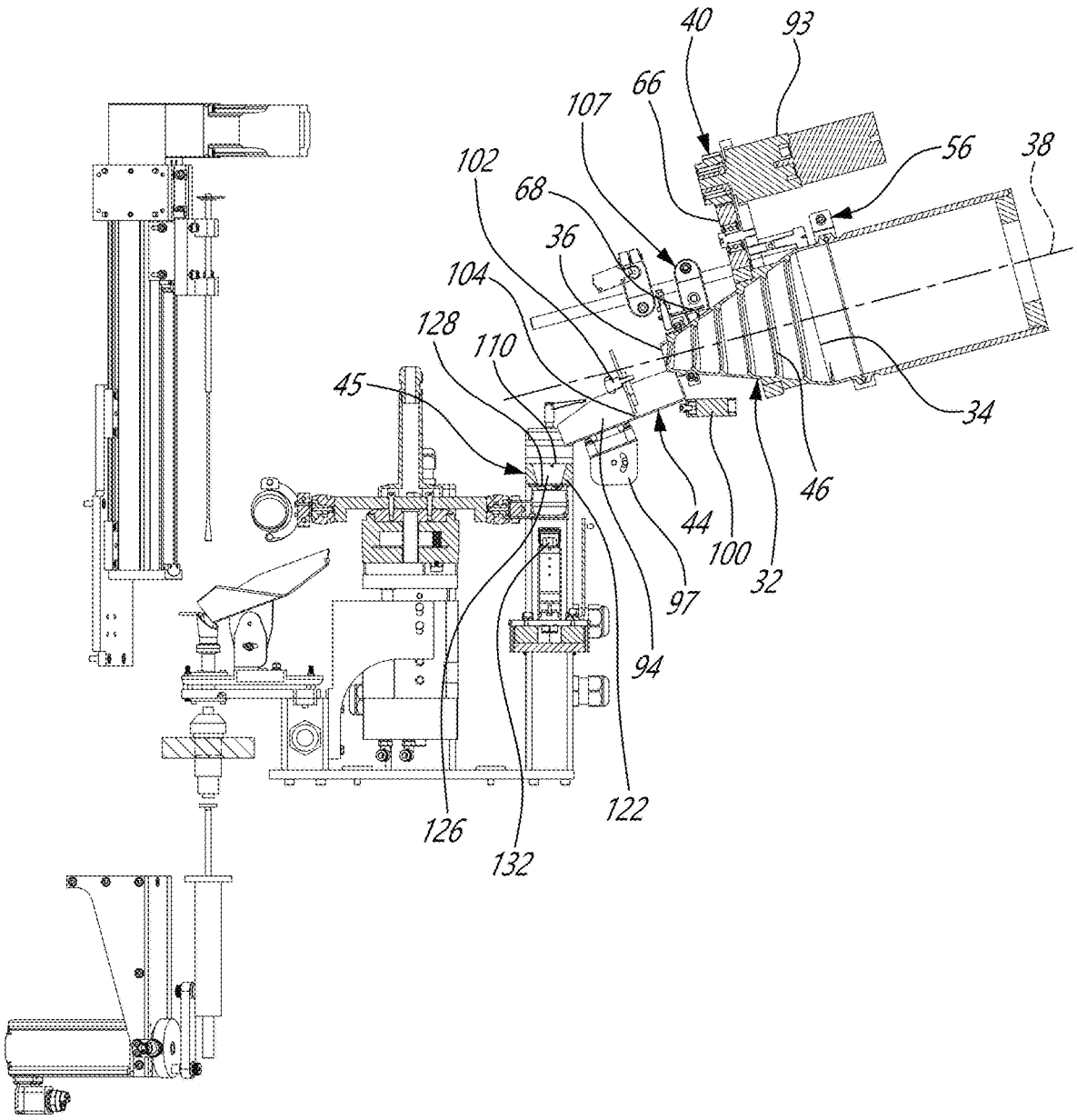
FIG. 3 is cross sectional front view of the system from FIG. 1.
Figure 4:
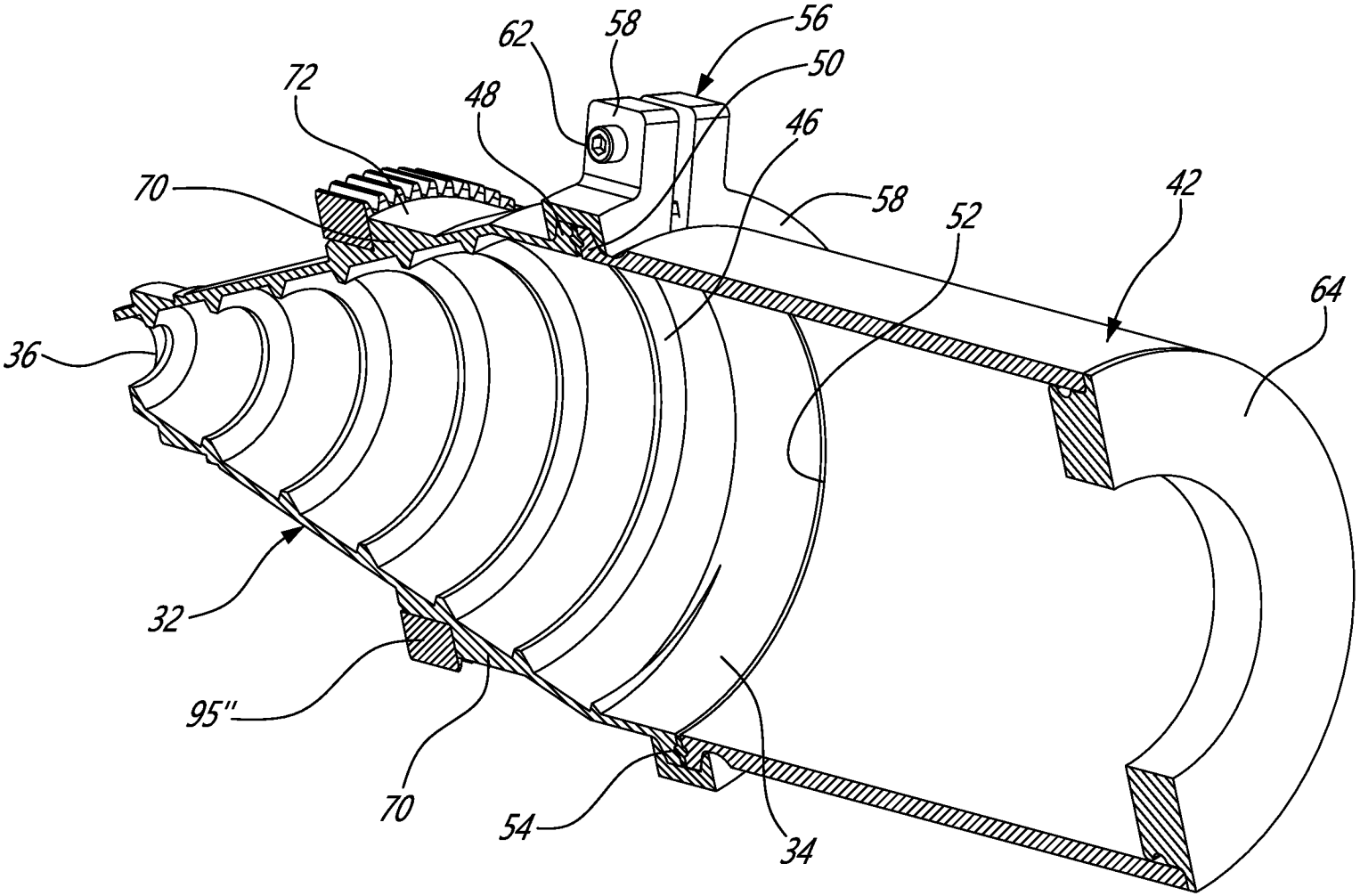
FIG. 4 is a cross sectional perspective of the feeding rotary tumbler that is part of the cannabis feeding system shown in FIG. 1.
Figure 5:
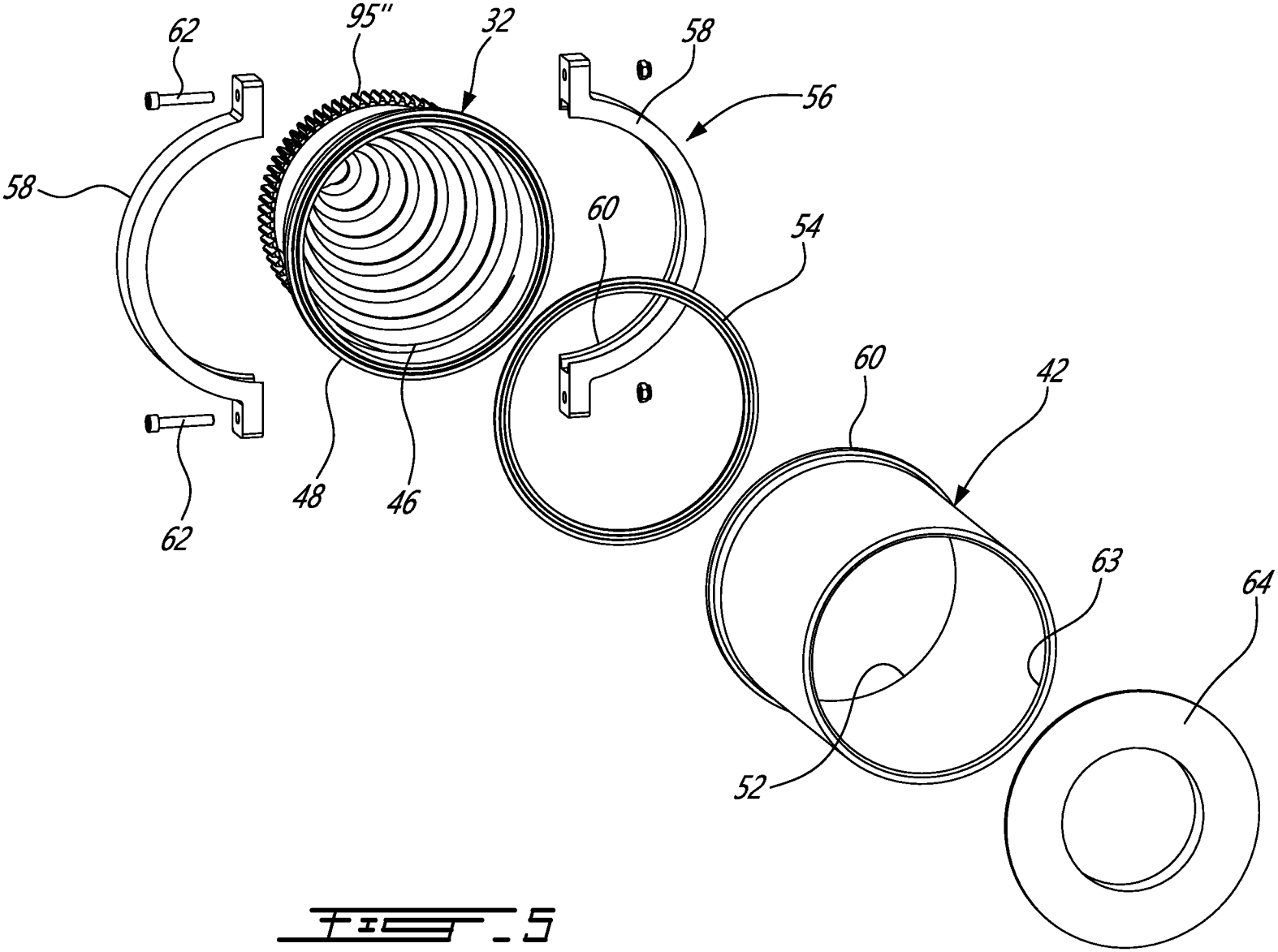
FIG. 5 is an exploded view of the feeding cone from FIG. 4.

With references briefly to FIGS. 1 to 3, and as described hereinabove, cannabis in bulk is precisely moved from the cone extension 42 to the cup 26 that has been moved adjacent thereto until the predetermined single portion thereof has been transferred. The controllable gate 45 is then closed and the single portion cannabis distributing device 24 is energized so that the two cups 26 are switched between the cannabis weighing position and the cannabis distributing position. This cycle is repeated indefinitely during the cannabis joint filling process.

According to another embodiment (not shown), another mechanism than the turntable 136 is used to move a cup 26 from a cannabis filling and weighing position to a cannabis joint filling position.

With references now to FIGS. 1, 2 and 8A, the cannabis joint filling apparatus 12 will now be described in more detail.

The apparatus 12 comprises a funnel 188, positioned adjacent the single portion cannabis distributing device 24, for receiving the single dose of cannabis therefrom, a paper cone holder 190, positioned under the funnel 188, for receiving and holding a paper cone 14 therein, a pusher mechanism 192 for positioning the paper cone holder 190 in abutment with the funnel 190, and a reciprocating needle mechanism 194 that includes a needle 196 and a needle actuating mechanism 198 that causes the needle 196 to be moved in the paper cone holder 190 and to reciprocate while being moved out of the paper cone holder 190.

The funnel 188 includes a base portion 189 that is removably secured to the base 134 via a generally L-shaped mounting bracket 200 and includes an integral peripheral flange 202 for its securing thereto. The configuration and size of the base portion 189 is adapted for specific configuration and size of the paper cone 14 as will now be described in more detail. The funnel 188 further includes a neck portion 191 that is removably mounted to the base portion 189 therein.

The outer wall of the base portion 189 of the funnel 188 is thinner at the end 212 thereof opposite the neck portion 191. As will be explained hereinbelow in more detail, this thinning of the outlet portion 212 of the funnel 188 aims at facilitating the insertion of the top opening portion 214 of a paper cone 14 thereabout.

The generally L-shaped mounting bracket 200 includes a first portion 204 that is secured to the base 134 and a second generally planar hollow portion 206 that extends from the first portion 204 so as to be generally parallel to the base 134. The funnel 188 is attached to the generally planar hollow portion 206 via its flange 202 using fasteners 208.

The hollow portion 206 has an opening 210 that is concentric with the outlet 212 of the funnel 188. A collar flange 211 is provided in the opening 210, which yields a gradually narrowing passage for the paper cone 14 therein. The opening yielded by the collar flange 211 being wider than the outlet 212 of the funnel 188, this facilitates the insertion of the top portion 214 of the paper cone 14 therethrough for positioning about the outlet 212 of the funnel 188.

The cannabis joint filling apparatus 12 further includes an air blaster (only the exit nozzle 256 thereof being shown) that pushes air into the funnel 188 during the positioning of a paper cone 14. The blasted air forces that the paper cone 14 remains open during the positioning of its opening 214 around the outlet 212 of the funnel 188.

The paper cone holder 190 is in the form of an elongated body having a frusto-conical bore 216 therein that is configured and sized to receive a paper cone 14 therein in a snugly fit manner so as to prevent the deformation and breakage of a cone 14 therein during its filling by cannabis.

The paper cone holder 190 is one of a series of such holders 190 that are freely mounted in corresponding holes 217 in a carrousel 218. The carrousel 218 is provided to facilitate the consecutive filling of a plurality of paper cones 14.

According to another embodiment (not shown), the paper cone holder 190 is mounted to another support or mechanism than the carrousel 218 that can allow receiving and supporting a single paper cone holder or sequentially a plurality thereof.

The paper holder 190 includes a wider head portion 220, defining a shoulder portion 222 that provides support to the holder 190 when deposited into the hole 217.

Figure 8A:
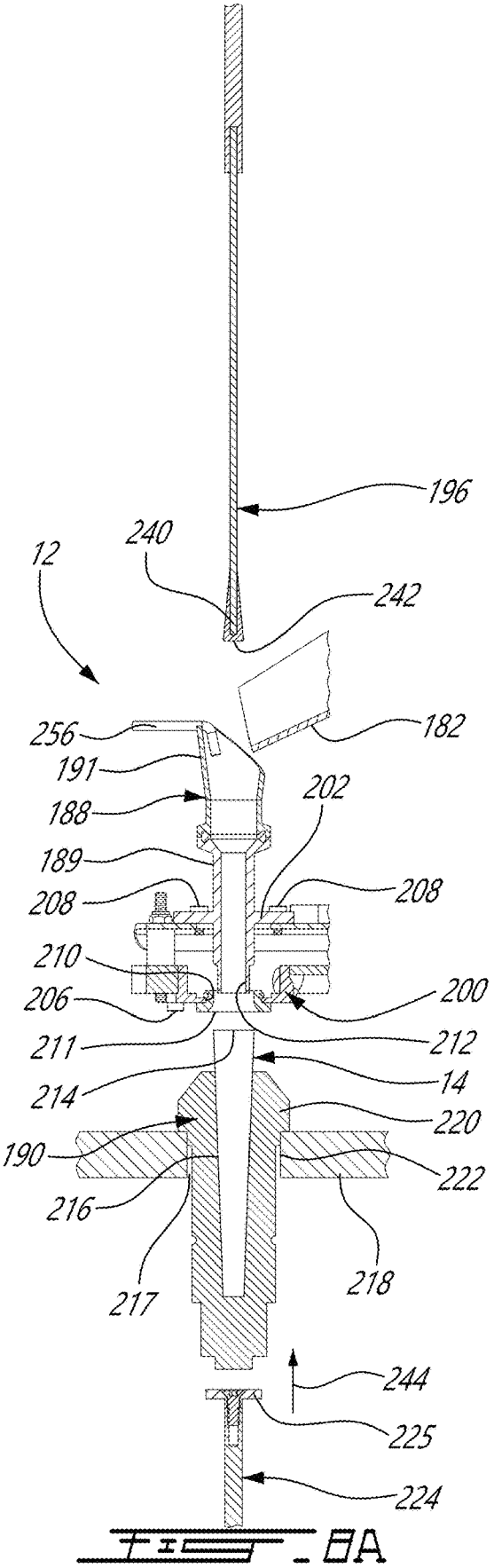
FIGS. 8A to 8P are cross sections of parts of the cannabis joint filling apparatus, part of the system from FIG. 1.
Figure 8B:
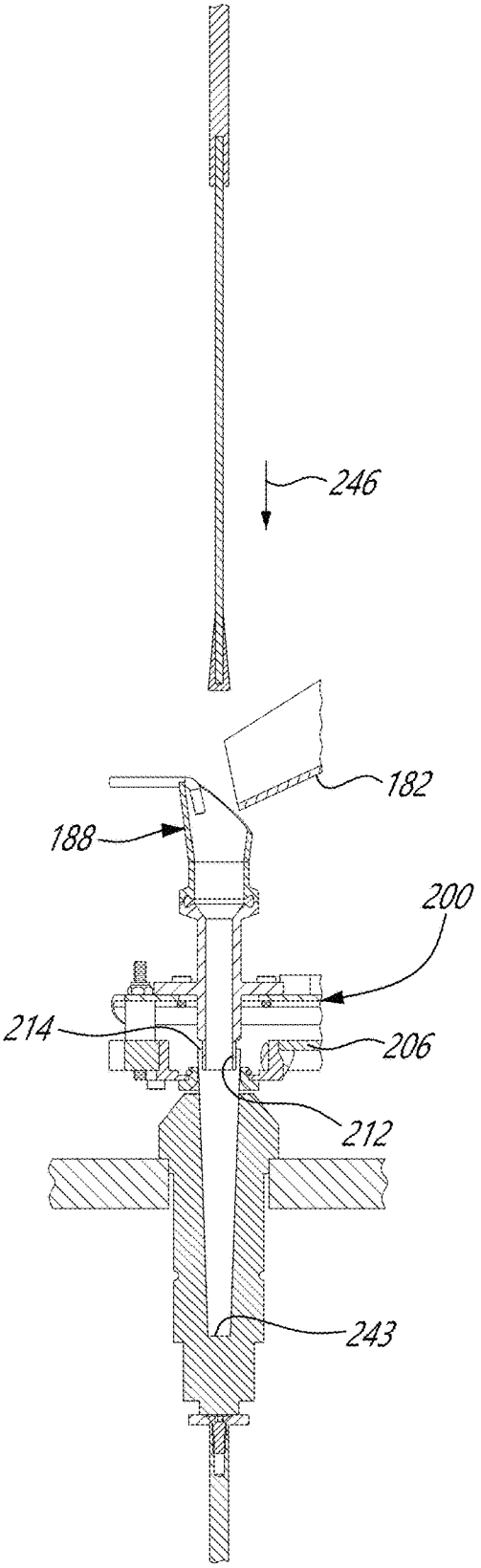

The pusher mechanism 192 includes a pushed rod 224, having a flat head 225 at the distal end thereof, that is aligned with the funnel 188 under the carrousel 218, The pusher mechanism 192 further includes a rod actuating mechanism 226 that controllably causes the rod 224 to be moved upwardly so as to bring the head portion 220 in abutment with the hollow portion 206 of the bracket 200 (see FIG. 8B). As can be seen in FIG. 8B, this positioning of the paper holder 190 causes the wider top portion 214 of the paper cone 14 therein to slip around the outlet 212 of the funnel 188.

The pusher rod 224 is slidably mounted into a sleeve 227 so as to extend partially therefrom. The sleeve 227 includes a top flange 229 for securing the sleeve 229 to a table or to another structure (not shown).

The rod actuating mechanism 226 includes a mounting bracket 228 that mounts the pusher mechanism 192 to the table so that the pusher rod 192 is under the funnel 188, aligned with the outlet 212 thereof.

The rod actuating mechanism 226 further includes a rotary actuator 230 fixed to the mounting bracket 228, an eccentric pulley assembly 232 mounted to both the rotary actuator 230 and pusher rod 224 therebetween that transform the rotational movement of the output shaft 234 of the rotary actuator 230 into a reciprocating movement of the rod 224 within the sleeve 227.

In operation, the rod actuating mechanism 226 is actuated each time the carrousel 218 brings a new paper cone holder 190, with a paper cone 14 therein, in alignment with the funnel 188 so as to insert the opening 214 of a paper cone 14 around the outlet 212 of the funnel 188. In such a position, the paper cone 14 is ready to be filled with the single dose 15 portion of cannabis. When the paper cone 14 is filled with such a dose 15, the rod actuating mechanism 226 is further energized to lower the rod 224, which causes the cone holder 190 to also lower to its resting position within the carrousel 218. This process is performed for each new paper cone 14 and holder 190 in the carrousel 218.

The chute 182 includes a V-shaped channel 94 and a pneumatic vibrator 100 operatively coupled thereto. The V-shaped channel 94 is adjustably mounted to the planar portion 206 of the mounting bracket 200 through an azimuthal mount 236. According to another embodiment (not shown) the V-shaped channel is fixedly or adjustably positioned between the single portion cannabis distributing device 24 and funnel 188 using another support, mechanism or assembly than illustrated.

The vibrator 100 of the chute 182 is operated so as to yield a regular vibration.

The cannabis joint filling apparatus 12 is not limited to include the illustrated funnel 188, paper cone holder 190, pusher mechanism 192 and/or carrousel 218, and other mechanisms or assemblies can be provided to bring a paper cone 14 in filling proximity with the single portion cannabis distributing device 24 for its filling.

The reciprocating needle mechanism 194 comprises a linear actuator 198, including a movable carriage 238 to which the needle 196 is attached.

The needle 196 includes a conical tip 240 that is shaped to be largest at its free end 242. More specifically, the diameter of the tip 240, at its free end 242, is slightly smaller than the diameter of the paper cone 14 and of the bottom 243 of the bore 216 of the paper cone holder 190.

As described hereinabove, the needle actuating mechanism 198 is controlled to move the needle 196 in the paper cone holder 190 and to reciprocate while being moved out of the paper cone holder 190.

The operation of the cannabis joint filling apparatus 12 will now be described with references to FIGS. 2 and 8A-8P.

As described hereinabove, the single portion cannabis distributing device 24 simultaneously i) receives cannabis from the feeding cone 32 and hold it while it is weighed by the weighing scale 20 so as to yield a single dose 15 of cannabis in one of its cups 26, while ii) the other cup 26 emptying another such single dose 15 of cannabis into a paper cone 14 held in the paper cone holder 190.

After an empty paper cone 14 is fed into the holder 190, and previously to afore-mentioned simultaneous steps, the pusher mechanism 192 is actuated to position the paper cone holder 190 in abutment with the funnel 188 (see arrows 244 in FIG. 8A). As described hereinabove, this positions the paper cone 14 about the outlet 212 of the funnel 188 (see FIG. 8B).

The operation of the needle 196 during the emptying of the cup 26 into the paper cone 14 will now be described in more detail with references to FIGS. 8D-8P, which results in the pre-compacting of the cannabis in the paper cone 14.

Figure 9:
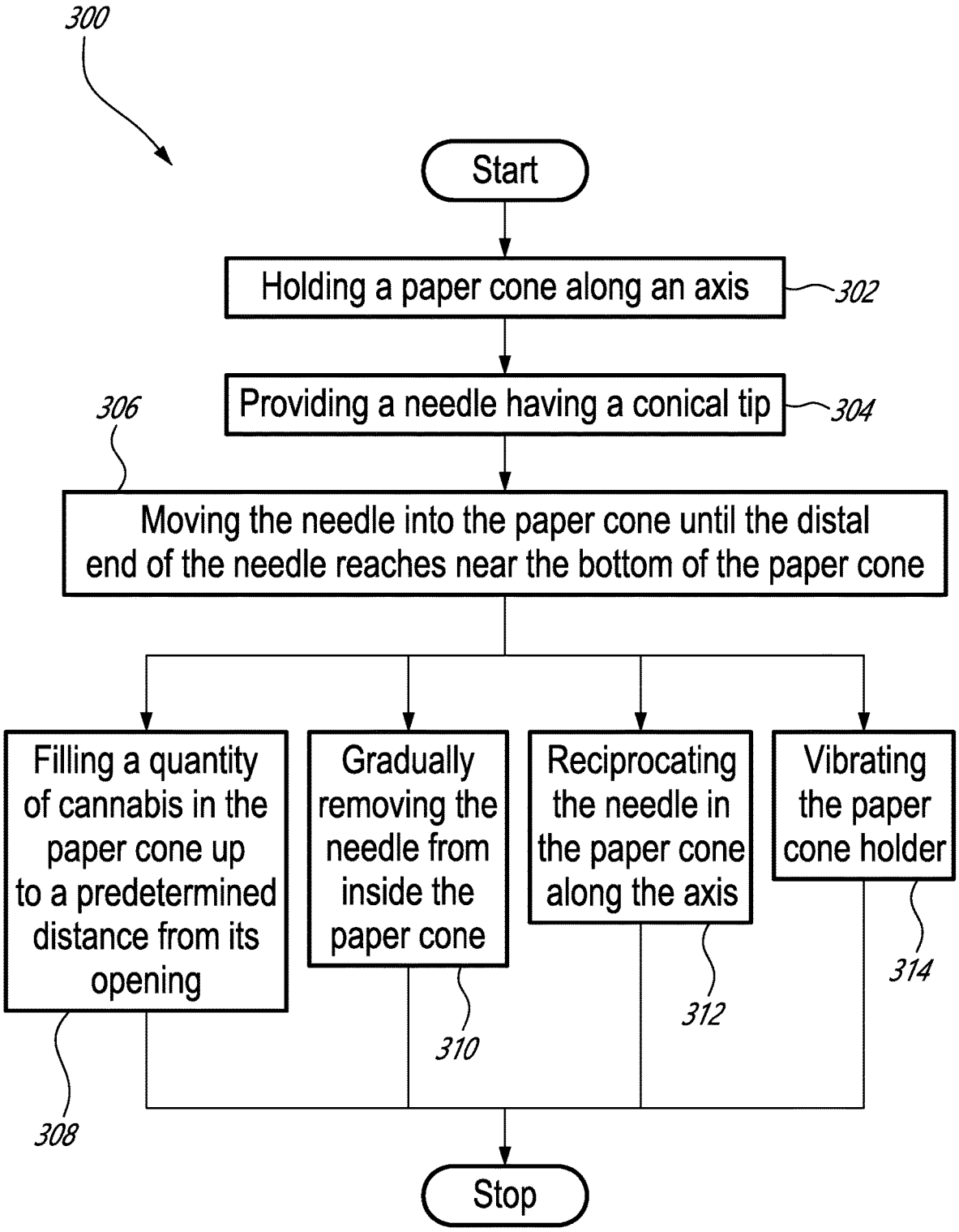
FIG. 9 is a flowchart of a method for pre-compacting cannabis in a paper cone.

FIG. 9 summarizes the method of pre-compacting the single dose 15 of cannabis in the paper cone 14.

Figure 8C:
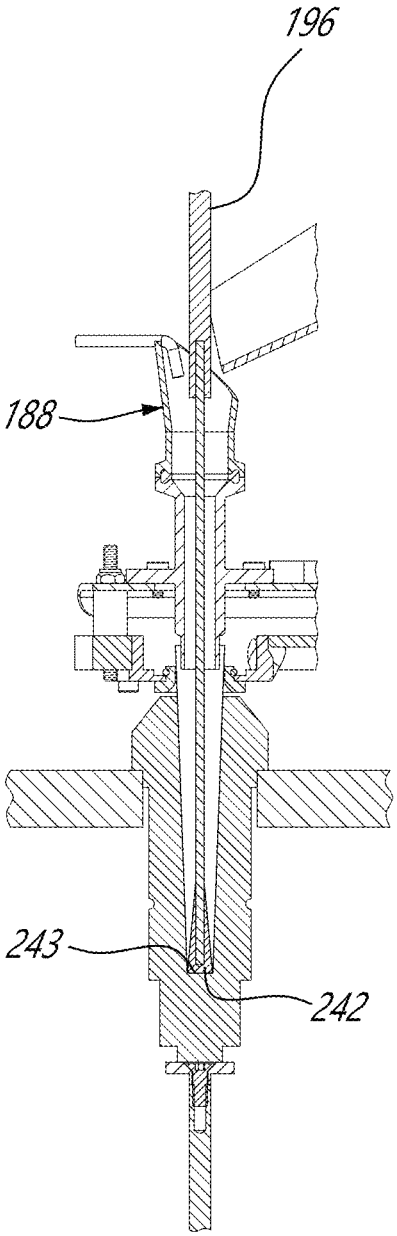
Figure 8D:
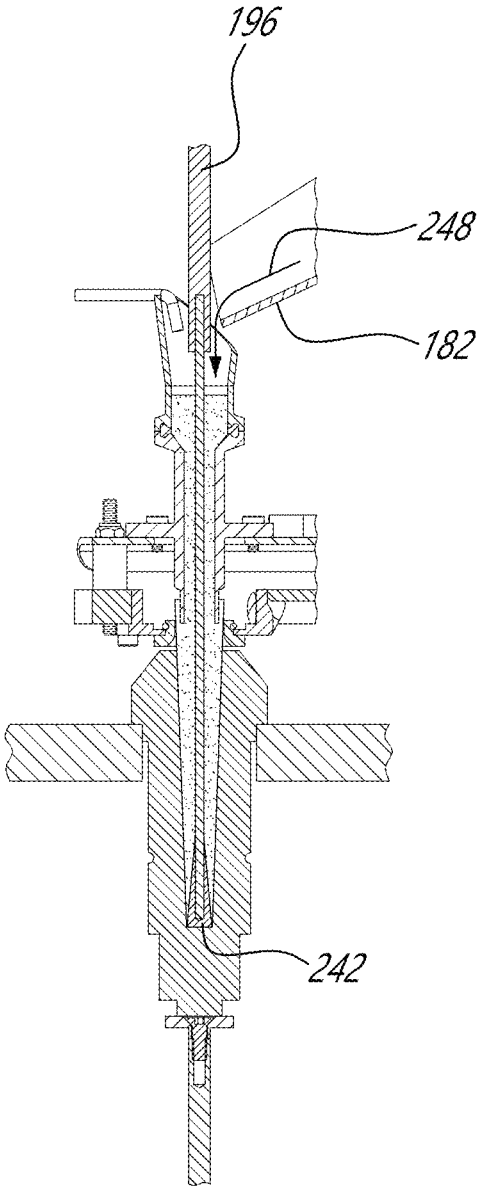
Figure 8E:
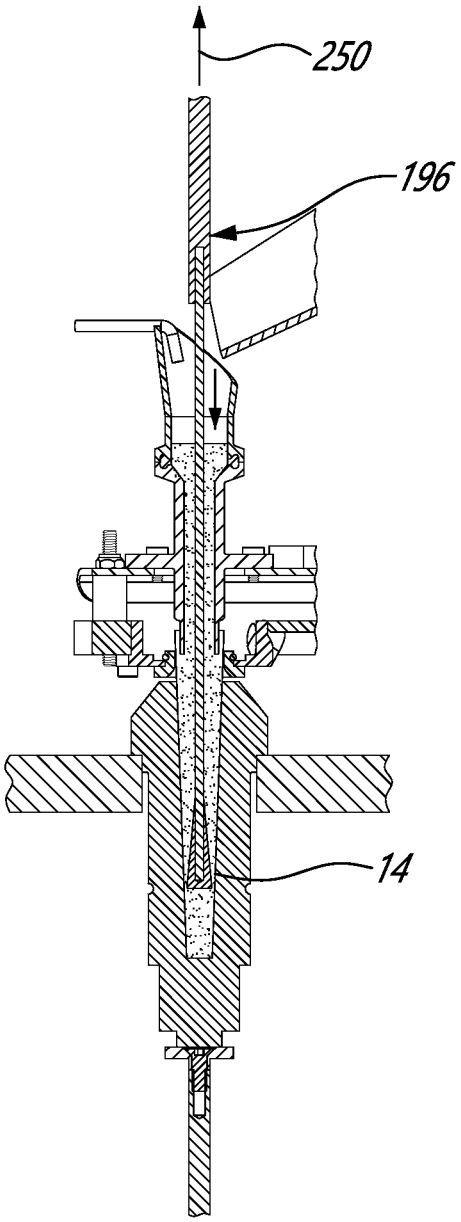
Figure 8F:
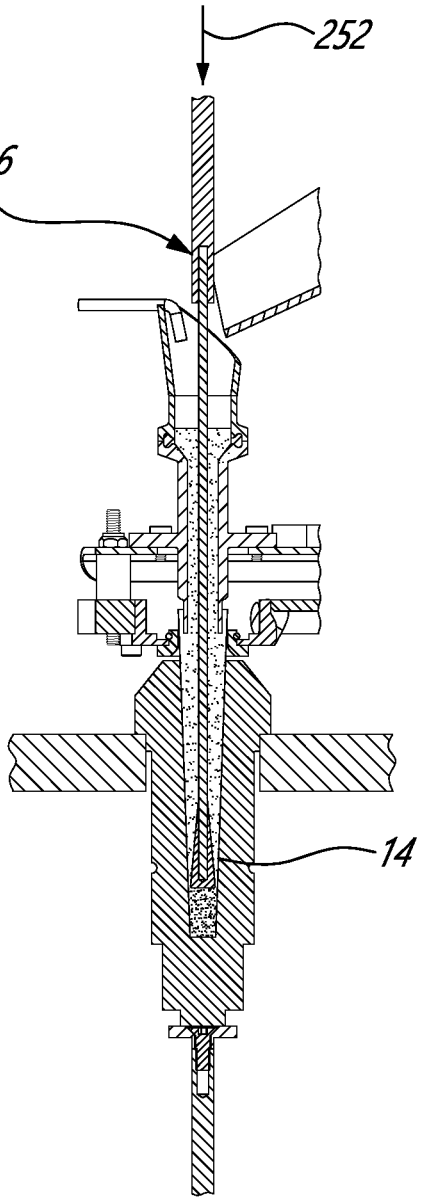
Figure 8G:
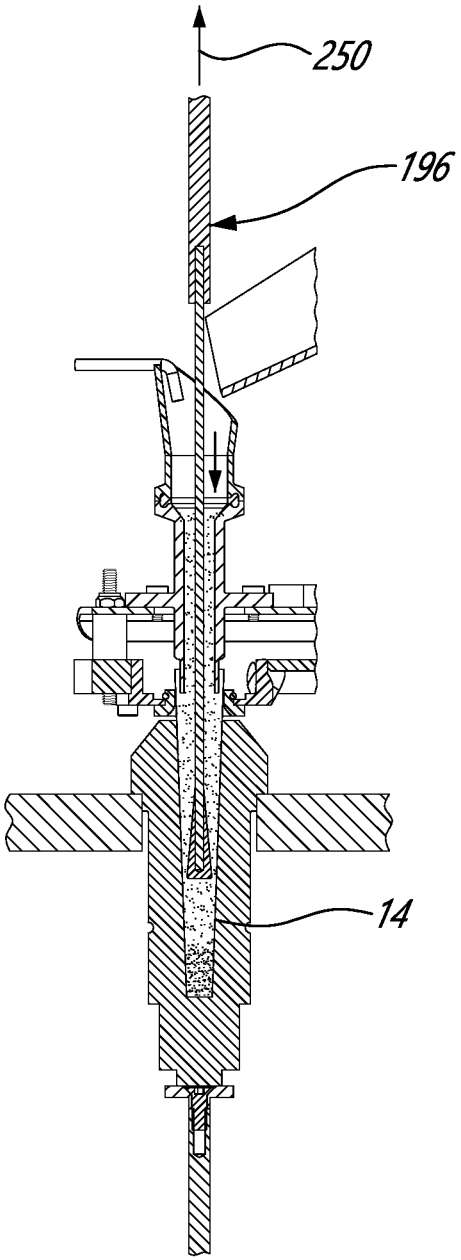
Figure 8H:
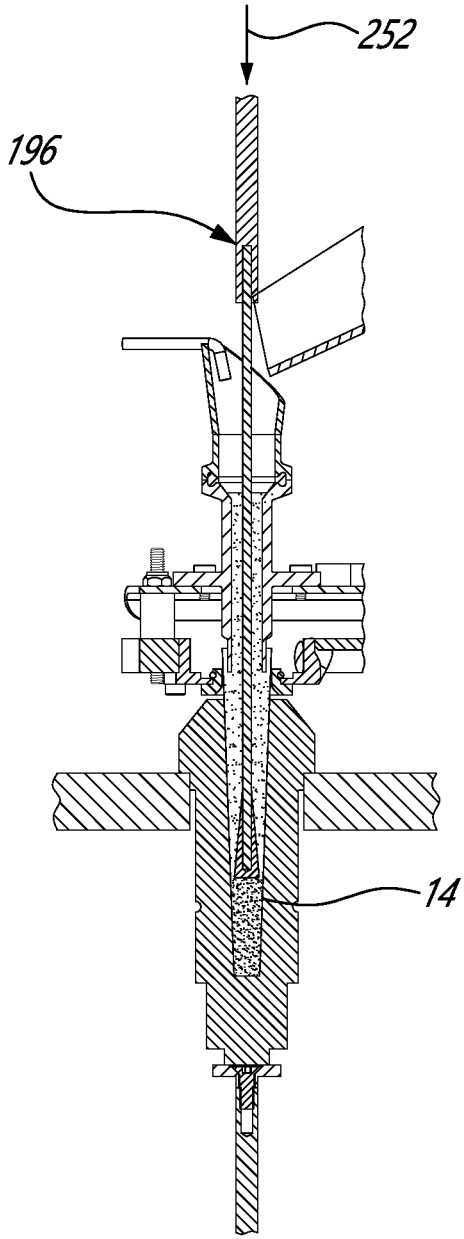
Figure 8I:
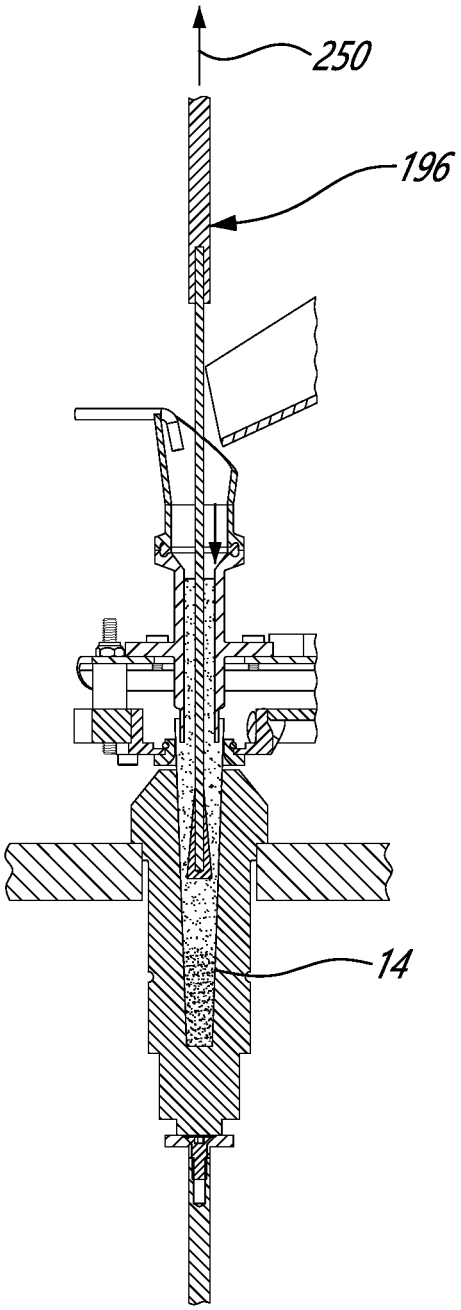
Figure 8J:
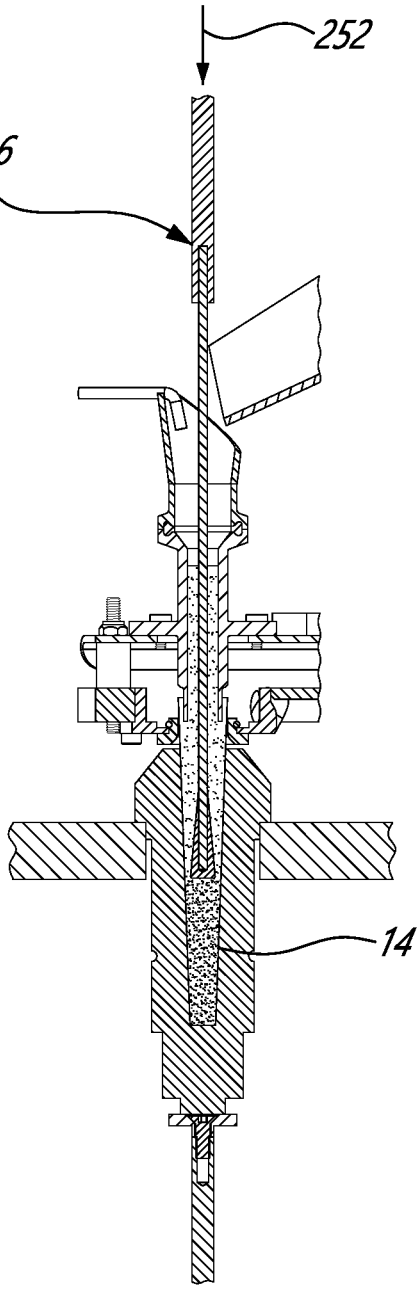
Figure 8K:
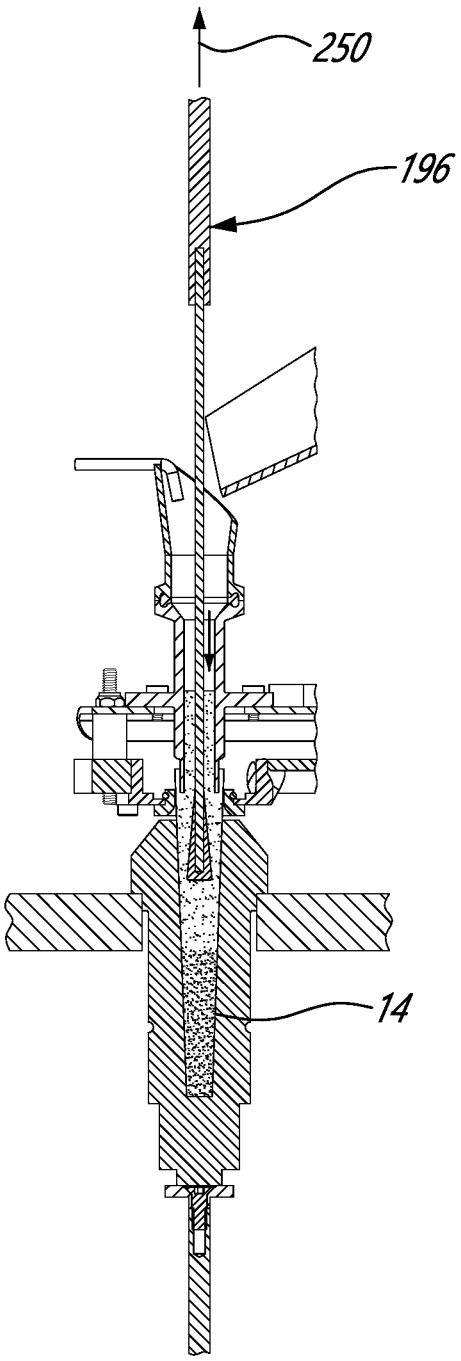
Figure 8L:
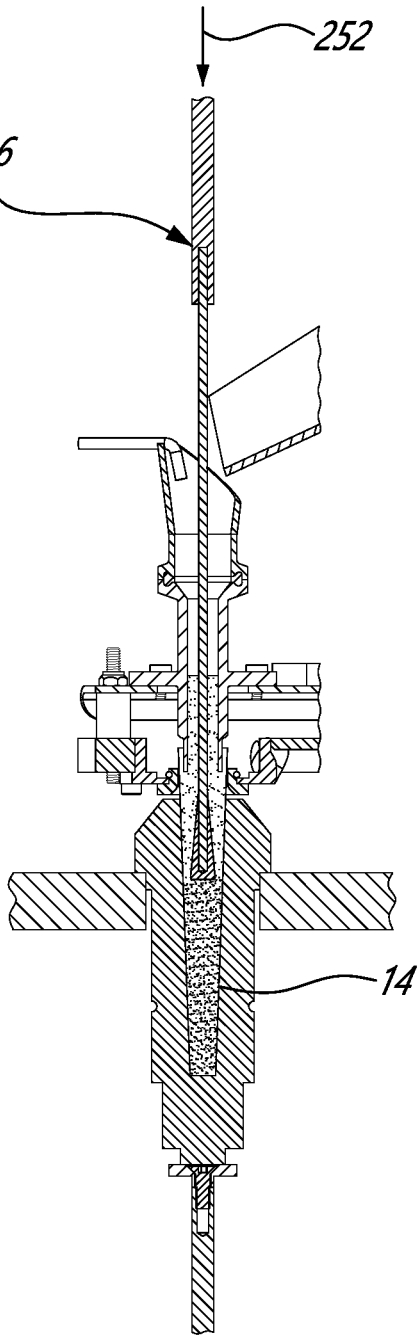
Figure 8M:
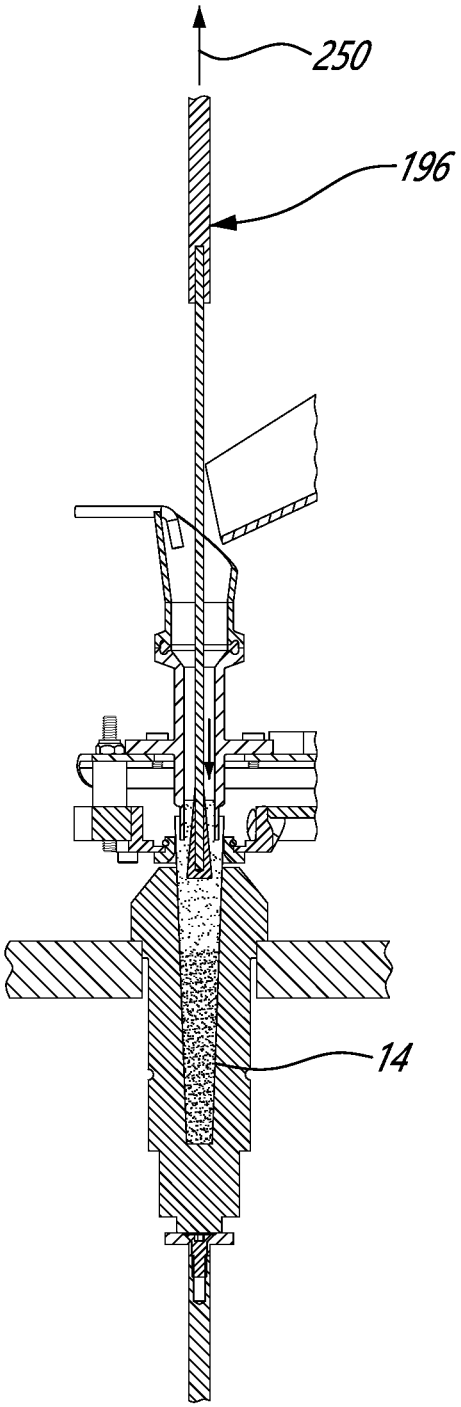
Figure 8N:
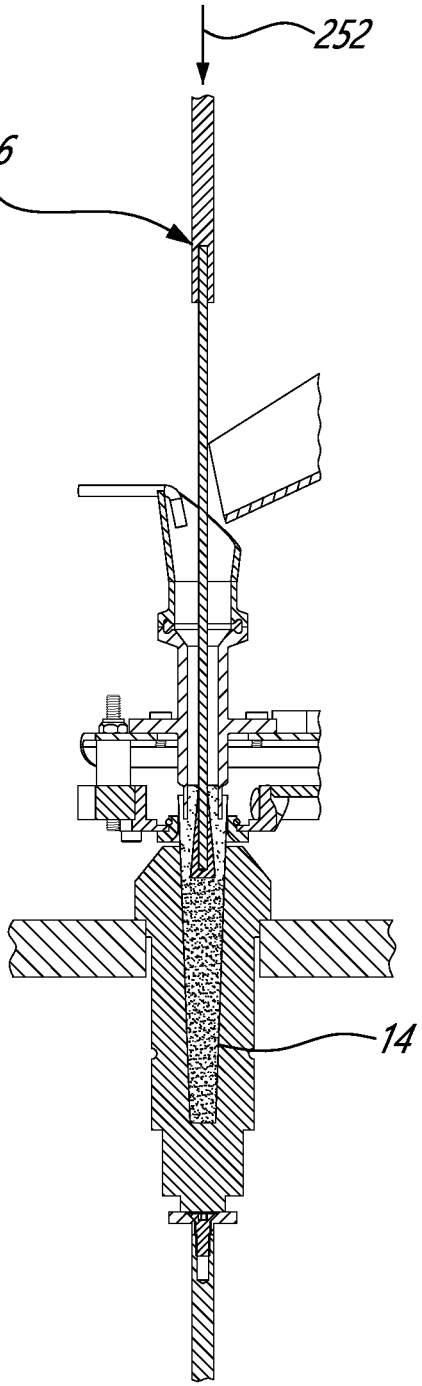
Figure 8O:
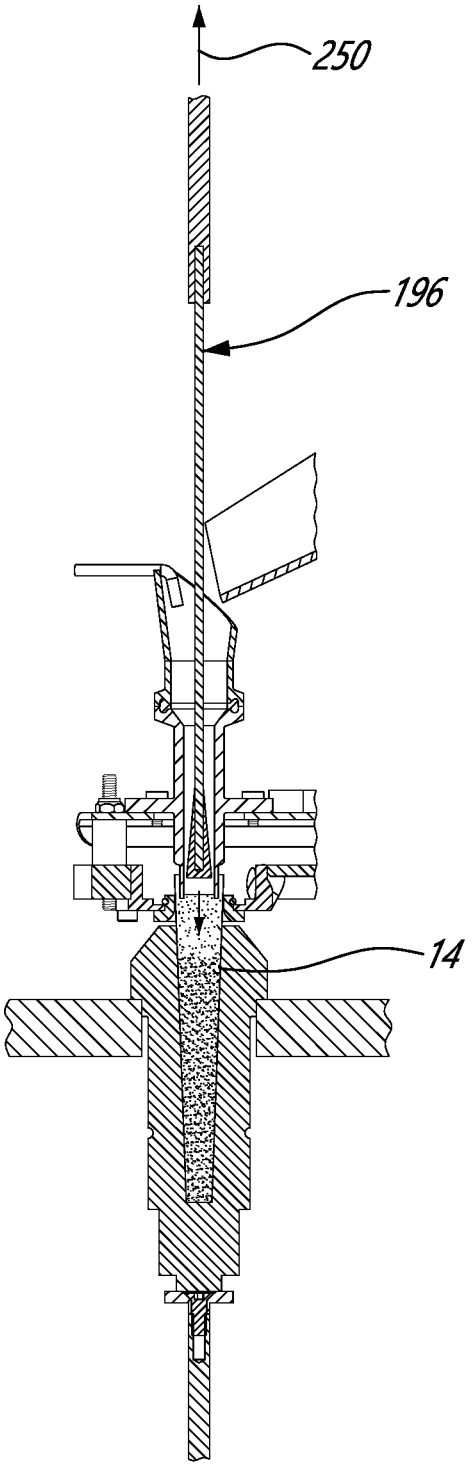
Figure 8P:
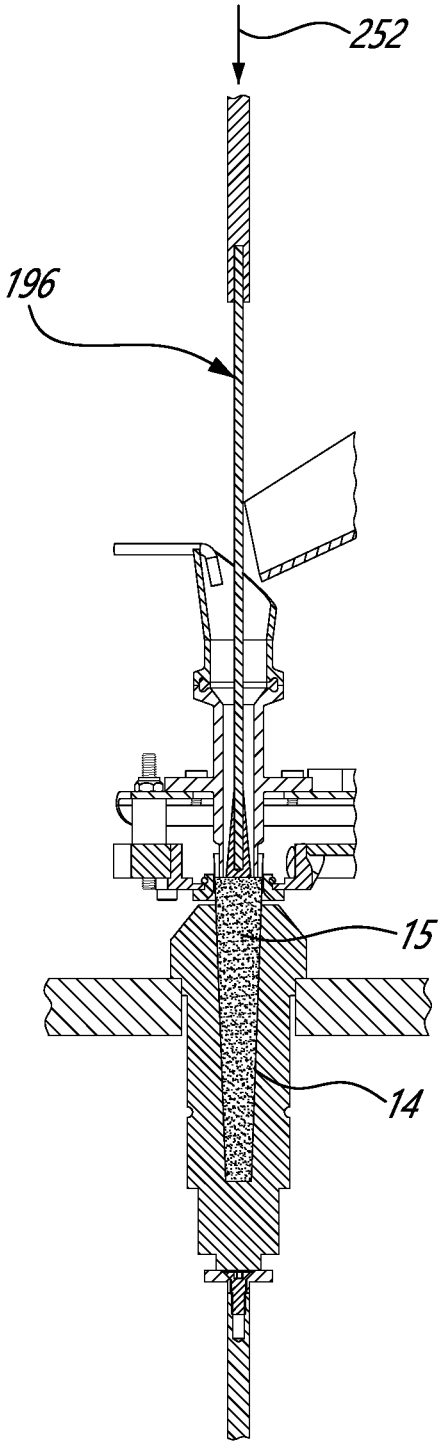

The linear actuator 198 is first operated to move the needle 196 within the paper cone 14 in the paper cone holder 190 (see arrow 246 in FIG. 8B) until the tip 242 gently reaches the bottom 243 of the bore 216 thereof, and therefore of the cone 14 therein (see FIG. 8C and step 306 in FIG. 9).

When the filling of the cone 14 is initiated by the single portion cannabis distributing device 24 (see arrow 248 in FIG. 8D and step 308 in FIG. 9), the linear actuator 188 gradually raises the needle 196 (step 310 in FIG. 9) while simultaneously inferring to the needle 196 a reciprocating movement within the cone 14 (step 312 in FIG. 9). The result of these two combine movements of the needle 196 is that the needle 196 is sequentially raised a first distance (see arrow 250 in FIGS. 8E, 8G, 8I, 8K, 8M and 8O) and the lowered a second distance that is shorter than the first distance (see arrow 252 in FIGS. 8F, 8H, 8J, 8L, 8N and 8P).

The resulting movements of the needle 196, which are illustrated in FIGS. 8E-8P, continue until the tip 242 of the needle 196 completely exits the paper cone 14.

The movements of the needle 196 are controlled to be synchronized with the gradual filling of the paper cone 14 with the single dose 15 of cannabis.

It is to be noted that the operation of the needle 196, and more specifically of its speed of movements, are adapted to the type of cannabis. For example, the total time to raise the needle 196 is for example between 0.5 and 1.5 seconds, while the reciprocating frequency is between 0.25 and 0.75 second.

The result of the above-described operation of the needle 196 during the filling of the paper cone 14 is the precompaction of the single dose 15 of cannabis 15 within the paper cone 14 after its filling.

At the same time of the above-described movements of the needle 196, the flat head 225 of the pusher rod 224 remains in abutment with the paper cone holder 190 and the pusher mechanism 192 is operated to cause the pushed rod 224 to reciprocate rapidly, inducing vibrations onto the paper cone holder 190 and paper cone 14 therein (step 314). This has been found to improve both the filling and pre-compacting of the single dose of cannabis 15 into the paper cone 14.

According to another illustrative embodiment, the pusher rod 224 remains still during the filling step.

Since an air blaster is believed to be well known in the art, it will not be described herein in more detail for concision purposes.

It is to be noted that all the actuators described hereinabove are connected to one or more controllers (not shown) so that their operations are triggered and synchronized thereby. All the connectors between such controller(s) and the actuators have been omitted in the drawings so as to alleviate the views.

It is to be noted that many modifications could be made to the cannabis joints filling system 10 described hereinabove and illustrated in the appended drawings. For example:

anyone or both chutes 44 can be replaced by another element or system allowing transferring the cannabis from one subsystem of the system 10 to the other. According to still another embodiment, anyone or both chutes are omitted; and the configuration, size and number of the mounting elements may be different than illustrated.

Although a cannabis joints filling system has been described hereinabove by way of illustrated embodiments thereof, it can be modified. It is therefore to be understood that numerous modifications may be made to the illustrative embodiments and that the scope of the claims should not be limited by the preferred embodiment but should be given the broadest interpretation consistent with the description as a whole.

What is claimed is:

1. A cannabis joints filling system comprising:

a cannabis joint filling apparatus for receiving and holding a paper cone along a longitudinal axis and for receiving and pre-compacting a predetermined quantity of cannabis into the paper cone; and a cannabis feeding system including i) a weighing scale, ii) a cannabis feeding apparatus adjacent the weighing scale for receiving cannabis in bulk and for controllably outputting a predetermined portion of the cannabis in bulk onto the weighing scale, and iii) a device for distributing a single portion of cannabis, including two cups that are sequentially movable between a) a cannabis weighing position, wherein one of the two cups cooperates with the weighing scale to measure the predetermined portion of the cannabis, and b) a cannabis distributing position, where the predetermined portion of the cannabis is fed to the cannabis joint filling apparatus wherein the cannabis feeding apparatus including:

a support frame;

a feeding cone defining a large inlet for said receiving cannabis in bulk and a narrow outlet for said controllably outputting a predetermined portion of the cannabis in bulk onto the weighing scale; the feeding cone being mounted to the support frame for rotation about a rotational axis that is so angled relative to a horizontal axis that the inlet is higher than the outlet; the feeding cone having an inner surface and including a spiral shaped protrusion on the inner surface; and an actuating mechanism secured to the frame and operatively coupled to the feeding cone for selectively causing the rotation of the feeding cone;

whereby, in operation, cannabis fed in bulk into the inlet of the feeding cone is gradually moved to the outlet thereof by the spiral shaped protrusion when the feeding cone is caused to rotate by the actuating mechanism.

2. The cannabis joints filling system as recited in claim 1, wherein the cannabis feeding apparatus further includes:

a cone extension secured to the feeding cone at the inlet thereof so as to be in fluid communication therewith and defining a recipient to receive the cannabis in bulk;

whereby, in operation, cannabis fed in bulk into the cone extension is brought by gravity to the inlet of the feeding cone.

3. The cannabis joints filling system as recited in claim 1, wherein the support frame includes a plate having a circular opening that receives the feeding cone therein for the rotation about the rotational axis.

4. The cannabis joints filling system as recited in claim 3, wherein the actuating mechanism includes a rotary actuator and a transmission, both secured to the plate;

the transmission operatively coupling the actuating mechanism and the feeding cone.

5. The cannabis joints filling system as recited in claim 1, further comprising a chute between the cannabis feeding apparatus and the weighing scale for transferring by gravity some of the cannabis in bulk from the cannabis feeding apparatus onto the weighing scale.

6. The cannabis joints filling system as recited in claim 5, wherein the chute includes a V-shaped channel.

7. The cannabis joints filling system as recited in claim 6, further comprising at least one sensor so mounted to the support frame as to have a line of sight to the V-shaped channel for detecting a flow of cannabis between the cannabis feeding apparatus and the weighing scale; the flow of cannabis being used for said controllably outputting a predetermined portion of the cannabis in bulk onto the weighing scale.

8. The cannabis joints filling system as recited in claim 6, wherein the chute further includes a vibrator secured to the V-shaped channel to induce vibrations thereon.

9. The cannabis joints filling system as recited in claim 8, wherein the vibrator is controllable to induce stronger first vibrations that are regular and then fainter second vibrations that gradually diminish relative to the first vibrations.

10. The cannabis joints filling system as recited in claim 5, further comprising a controllable gate positioned downstream from the chute and upstream from the weighing scale, for controlling a flow of cannabis therebetween.

11. The cannabis joints filling system as recited in claim 10, wherein the controllable gate includes a recipient that is mounted above the weighing scale; the container having an opening and a bottom that is movable between a first position that blocks the opening and a second position that yields a passage through the opening.

12. The cannabis joints filling system as recited in claim 11, wherein the opening of the recipient is frusto-conical.

13. The cannabis joints filling system as recited in claim 11, wherein the bottom is slidably mounted to the recipient; the controllable gate further including a linear actuator for selectively sliding the bottom relatively to the recipient.

14. A cannabis joints filling system comprising:

a cannabis joint filling apparatus for receiving and holding a paper cone along a longitudinal axis and for receiving and pre-compacting a predetermined quantity of cannabis into the paper cone;

a cannabis feeding system including i) a weighing scale, ii) a cannabis feeding apparatus adjacent the weighing scale for receiving cannabis in bulk and for controllably outputting a predetermined portion of the cannabis in bulk onto the weighing scale, and iii) a device for distributing a single portion of cannabis, including two cups that are sequentially movable between a) a cannabis weighing position, wherein one of the two cups cooperates with the weighing scale to measure the predetermined portion of the cannabis, and b) a cannabis distributing position, where the predetermined portion of the cannabis is fed to the cannabis joint filling apparatus; and at least one sensor for detecting a flow of cannabis between the cannabis feeding apparatus and the weighing scale; the flow of cannabis being used for said controllably outputting a predetermined portion of the cannabis in bulk onto the weighing scale.

15. The cannabis joints filling system as recited in claim 1, wherein the weighing scale is an electronic-type scale.

16. The cannabis joints filling system as recited in claim 1, wherein the device for distributing a single portion of cannabis comprising:

a primary support base; and a turntable receiving the two cups; the turntable being mounted to the primary support base for movement about a rotational axis that causes each cup to be positioned alternatively i) adjacent the cannabis joint filling apparatus and ii) coaxial with the weighing scale.

17. The cannabis joints filling system as recited in claim 16, wherein the device for distributing a single portion of cannabis further comprising a secondary base that receives the primary support base for reciprocal movement of the primary support base relatively to the secondary support base along the rotational axis between a low position, wherein one of the two cups that is coaxial with the weighing scale is supported by the weighing scale, and a raised position, wherein the one of the two cups that is coaxial with the weighing scale is distanced from the weighing scale.

18. The cannabis joints filling system as recited in claim 17, wherein each one of the two cups is mounted to the turntable via an actuator for pivotal movement about a pivot axis, that is generally perpendicular to the rotational axis, between an upright position, wherein said each one of the two cups is right side up, and a tilted position more than ninety (90) degrees relative to a horizontal axis, which causes said each one of the two cups to be emptied of any content therein.

19. The cannabis joints filling system as recited in claim 18, wherein each cup is further mounted to the actuator via a mounting bracket for free movements towards a rested position, wherein the cup is supported by the mounting bracket;

whereby, in operation, the weighing position corresponds to a) the cup being coaxial with the weighing scale, while b) the primary support being in its low position, and c) while the cup being in its upright position; the cannabis distributing position corresponding with a) the cup being positioned adjacent the cannabis joint filling apparatus, while b) the primary support being in its low position, and c) while the cup being in its tilted position.

20. The cannabis joints filling system as recited in claim 1, wherein the cannabis joint filling apparatus includes a paper cone holder for receiving and holding the paper cone adjacent the device for distributing a single portion of cannabis so as to be in fluid communication with one of the two cups thereof when said one of the two cups is in the cannabis distributing position.

21. The cannabis joints filling system as recited in claim 20, wherein the cannabis joint filling apparatus further including a funnel positioned above the paper cone holder and oriented along the longitudinal axis; the funnel orienting the cannabis fed to the cannabis joint filling system towards the paper cone held by the paper cone holder.

22. The cannabis joints filling system as recited in claim 21, further comprising a chute between the device for distributing a single portion of cannabis and the funnel.

23. The cannabis joints filling system as recited in claim 22, wherein the chute includes a V-shaped channel.

24. The cannabis joints filling system as recited in claim 23, wherein the chute further including a vibrator secured to the V-shaped channel to induce vibrations thereon.

25. The cannabis joints filling system as recited in claim 1, wherein the cannabis joint filling apparatus further including i) a reciprocating needle mechanism including a needle, having a conical tip, and ii) an actuating mechanism to controllably cause the needle to reciprocate in the paper cone along the longitudinal axis while moving from a first position, wherein the conical tip is at a bottom of the paper, and a second position, wherein the conical tip is out of the paper cone.

26. The cannabis joints filling system as recited in claim 25, wherein the conical tip of the needle has a widest portion at a free end thereof.

* * * * *